US010434771B2

(12) United States Patent
Kawatoko et al.

(10) Patent No.: US 10,434,771 B2
(45) Date of Patent: Oct. 8, 2019

(54) RECORDING APPARATUS AND RECORDING METHOD

(71) Applicant: CANON KABUSHIKI KAISHA, Tokyo (JP)

(72) Inventors: Norihiro Kawatoko, Yokohama (JP); Kentaro Muro, Tokyo (JP); Masashi Hayashi, Yokohama (JP); Eiji Komamiya, Kawasaki (JP); Tetsuya Edamura, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/010,224

(22) Filed: Jun. 15, 2018

(65) Prior Publication Data

US 2019/0001669 A1 Jan. 3, 2019

(30) Foreign Application Priority Data

Jun. 29, 2017 (JP) ..... 2017-127996

(51) Int. Cl.
*B41J 2/045* (2006.01)
*B41J 2/21* (2006.01)

(52) U.S. Cl.
CPC ..... *B41J 2/04573* (2013.01); *B41J 2/0458* (2013.01); *B41J 2/04508* (2013.01); *B41J 2/04543* (2013.01); *B41J 2/2135* (2013.01)

(58) Field of Classification Search
CPC .. B41J 2/04573; B41J 2/2135; B41J 2/04543; B41J 2/0458; B41J 2/04508; B41J 2/13; B41J 25/003
See application file for complete search history.

(56) References Cited

U.S. PATENT DOCUMENTS

2010/0309242 A1* 12/2010 Chikuma ..... B41J 2/2135 347/14

FOREIGN PATENT DOCUMENTS

JP 2006-334899 A 12/2006

OTHER PUBLICATIONS

IP.com search (Year: 2019).*

* cited by examiner

*Primary Examiner* — Lisa Solomon
(74) *Attorney, Agent, or Firm* — Canon USA, Inc., IP Division

(57) ABSTRACT

An apparatus includes a recording head including a first discharge port array and a second discharge port array, the first and second discharge port arrays being shifted and arranged in a first direction so that part of the discharge ports arranged at an end portion of the first discharge port array in the first direction and part of the discharge ports arranged at an end potion of the second discharge port array in the first direction are located at the same positions in the first direction. The plurality of discharge ports in each of the first and second discharge port arrays is obliquely arranged at a predetermined tilt with respect to the first direction. Discharge timing is adjusted based on the tilt of the discharge port arrays.

20 Claims, 23 Drawing Sheets

FIG.6A

| CH0 | |
|---|---|
| seg | DRIVING ORDER |
| 0 | 1 |
| 1 | 5 |
| 2 | 2 |
| 3 | 6 |
| 4 | 3 |
| 5 | 7 |
| 6 | 4 |
| 7 | 8 |

FIG.6B

| CH1 | |
|---|---|
| seg | DRIVING ORDER |
| 0 | 4 |
| 1 | 8 |
| 2 | 1 |
| 3 | 5 |
| 4 | 2 |
| 5 | 6 |
| 6 | 3 |
| 7 | 7 |

FIG.8A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | TOTAL AMOUNT OF DEVIATION | 0 | 0.75 | 0.625 | 1.375 | 1.25 | 2 | 1.875 | 2.625 |

FIG.8B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | DRIVING ORDER | 4 | 8 | 1 | 5 | 2 | 6 | 3 | 7 |
| | DRIVING DEVIATION AMOUNT | 0.375 | 0.875 | 0 | 0.5 | 0.125 | 0.625 | 0.25 | 0.75 |
| | TILT DEVIATION AMOUNT | 0 | 0.25 | 0.5 | 0.75 | 1 | 1.25 | 1.5 | 1.75 |
| | PULSE DELAY AMOUNT | 1.5 | 1.5 | 1.5 | 1.5 | 1.5 | 1.5 | 1.5 | 1.5 |
| | TOTAL AMOUNT OF DEVIATION | 1.875 | 2.625 | 2 | 2.75 | 2.625 | 3.375 | 3.25 | 4 |

FIG.10A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | TOTAL AMOUNT OF DEVIATION | 0 | 0.75 | 0.625 | 1.375 | 1.25 | 2 | 1.875 | 2.625 |

FIG.10B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | TOTAL AMOUNT OF DEVIATION | 0 | 0.75 | 0.625 | 1.375 | 1.25 | 2 | 1.875 | 2.625 |

FIG.12A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | TOTAL AMOUNT OF DEVIATION | 0 | 0.75 | 0.625 | 1.375 | 1.25 | 2 | 1.875 | 2.625 |

FIG.12B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | DRIVING ORDER | 4 | 8 | 1 | 5 | 2 | 6 | 3 | 7 |
| | DRIVING DEVIATION AMOUNT | 0.375 | 0.875 | 0 | 0.5 | 0.125 | 0.625 | 0.25 | 0.75 |
| | TILT DEVIATION AMOUNT | 0 | 0.25 | 0.5 | 0.75 | 1 | 1.25 | 1.5 | 1.75 |
| | TOTAL AMOUNT OF DEVIATION | 0.375 | 1.125 | 0.5 | 1.25 | 1.125 | 1.875 | 1.75 | 2.5 |

FIG.15A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | 0 | 0 | -1 | -1 | -1 | -1 |
| | TOTAL AMOUNT OF DEVIATION | 0 | 0.75 | 0.625 | 1.375 | 0.25 | 1 | 0.875 | 1.625 |

FIG.15B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | DRIVING ORDER | 4 | 8 | 1 | 5 | 2 | 6 | 3 | 7 |
| | DRIVING DEVIATION AMOUNT | 0.375 | 0.875 | 0 | 0.5 | 0.125 | 0.625 | 0.25 | 0.75 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | 0 | 0 | -1 | -1 | -1 | -1 |
| | PULSE DELAY AMOUNT | 0.5 | 0.5 | 0.5 | 0.5 | 0.5 | 0.5 | 0.5 | 0.5 |
| | TOTAL AMOUNT OF DEVIATION | 0.875 | 1.625 | 1 | 1.75 | 0.625 | 1.375 | 1.25 | 2 |

FIG.17A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | 0 | 0 | -1 | -1 | -1 | -1 |
| | TOTAL AMOUNT OF DEVIATION | 0 | 0.75 | 0.625 | 1.375 | 0.25 | 1 | 0.875 | 1.625 |

FIG.17B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | DRIVING ORDER | 4 | 8 | 1 | 5 | 2 | 6 | 3 | 7 |
| | DRIVING DEVIATION AMOUNT | 0.375 | 0.875 | 0 | 0.5 | 0.125 | 0.625 | 0.25 | 0.75 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | -1 | -1 | -1 | -1 | -2 | -2 |
| | PULSE DELAY AMOUNT | 0.5 | 0.5 | 0.5 | 0.5 | 0.5 | 0.5 | 0.5 | 0.5 |
| | TOTAL AMOUNT OF DEVIATION | 0.875 | 1.625 | 0 | 0.75 | 0.625 | 1.375 | 0.25 | 1 |

FIG.19A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | DRIVING ORDER | 1 | 5 | 2 | 6 | 3 | 7 | 4 | 8 |
| | DRIVING DEVIATION AMOUNT | 0 | 0.5 | 0.125 | 0.625 | 0.25 | 0.75 | 0.375 | 0.875 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | 0 | 0 | -1 | -1 | -1 | -1 |
| | FINE ADJUSTMENT AMOUNT | 0 | 0 | 0 | -1 | 0 | 0 | 0 | -1 |
| | TOTAL AMOUNT OF DEVIATION | 0 | 0.75 | 0.625 | 0.375 | 0.25 | 1 | 0.875 | 0.625 |

FIG.19B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | DRIVING ORDER | 4 | 8 | 1 | 5 | 2 | 6 | 3 | 7 |
| | DRIVING DEVIATION AMOUNT | 0.375 | 0.875 | 0 | 0.5 | 0.125 | 0.625 | 0.25 | 0.75 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | -1 | -1 | -1 | -1 | -2 | -2 |
| | FINE ADJUSTMENT AMOUNT | 0 | -1 | 0 | 0 | 0 | -1 | 0 | 0 |
| | PULSE DELAY AMOUNT | 0.5 | 0.5 | 0.5 | 0.5 | 0.5 | 0.5 | 0.5 | 0.5 |
| | TOTAL AMOUNT OF DEVIATION | 0.875 | 0.625 | 0 | 0.75 | 0.625 | 0.375 | 0.25 | 1 |

FIG.21A

| | | | | | | | | | |
|---|---|---|---|---|---|---|---|---|---|
| CH0 | seg | 0 | 1 | 2 | 3 | 4 | 5 | 6 | 7 |
| | COORDINATE | 0 | 1 | 2 | 3 | 4 | 5 | 6 | 7 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | 0 | 0 | -1 | -1 | -1 | -1 |
| | TOTAL AMOUNT OF DEVIATION | 0 | 0.25 | 0.5 | 0.75 | 0 | 0.25 | 0.5 | 0.75 |

FIG.21B

| | | | | | | | | | |
|---|---|---|---|---|---|---|---|---|---|
| CH1 | seg | 0 | 1 | 2 | 3 | 4 | 5 | 6 | 7 |
| | COORDINATE | 6 | 7 | 8 | 9 | 10 | 11 | 12 | 13 |
| | TILT DEVIATION AMOUNT | 0 | 0.25 | 0.5 | 0.75 | 1 | 1.25 | 1.5 | 1.75 |
| | ROUGH ADJUSTMENT AMOUNT | 0 | 0 | 0 | 0 | -1 | -1 | -1 | -1 |
| | PULSE DELAY AMOUNT | 0.5 | 0.5 | 0.5 | 0.5 | 0.5 | 0.5 | 0.5 | 0.5 |
| | TOTAL AMOUNT OF DEVIATION | 0.5 | 0.75 | 1 | 1.25 | 0.5 | 0.75 | 1 | 1.25 |

RECORDING APPARATUS AND RECORDING METHOD

BACKGROUND OF THE INVENTION

Field of the Invention

The aspect of the embodiments relates to a recording apparatus and a recording method.

Description of the Related Art

Recording apparatuses which record an image on a recording medium by using a recording head including a plurality of discharge ports for discharging ink are known. Among such recording apparatuses, ones using a recording head in which discharge ports are arranged for a range wider than the width of the recording medium have also been known recently.

Arranging the discharge ports in a row over a wide range can increase manufacturing costs and facilitate the occurrence of manufacturing errors of the discharge ports. In view of this, a recording head including a plurality of discharge port arrays in which discharge ports are arranged in a somewhat narrow range and which is arranged in the width direction of the recording medium can be used. Recording heads including a plurality of discharge port arrays arranged in the width direction with overlapping portions, in which discharge ports at widthwise ends of two adjoining discharge port arrays are located at the same positions in the width direction, are also known to be used. A drop in image quality due to differences in discharge characteristics between discharge port arrays can be suppressed by using such a recording head and performing recording in the overlapping portions in a shared manner by two discharge port arrays.

Suppose that recording elements in the discharge ports are time-divisionally driven, i.e., divided into a plurality of driving blocks and driven at different timings driving block by driving block. Such time-divisional driving may fail to provide satisfactory image quality even if the foregoing recording head with overlapping portions is used. If the recording elements in the discharge ports of the overlapping portion of two adjoining discharge port arrays differ in the order of driving, the impact positions of dots discharged from the discharge ports located at the same positions in the width direction deviate from each other in a direction crossing the width direction, whereby the image quality is impaired. Japanese Patent Application Laid-Open No. 2006-334899 discusses making the driving order of the recording elements different between the discharge port arrays so that the recording elements corresponding to the overlapping portion of two adjoining discharge port arrays are driven in the same order.

A recording head in which discharge port arrays are arranged at a predetermined tilt with respect to the width direction of the recording medium can be used to record high-resolution images because the widthwise distances between dots impacting on the recording medium can be made smaller than the arrangement pitches of the discharge ports in the discharge port arrays. However, if such a recording head including the discharge port arrays arranged at a predetermined tilt is used, the impact positions of the dots deviate according to the tilt, in a direction different from the width direction. Consequently, even if the technique discussed in Japanese Patent Application Laid-Open No. 2006-334899 is used, the impact positions of the dots in the overlapping portion can be different between the discharge port arrays and an image of satisfactory image quality may fail to be obtained.

SUMMARY OF THE INVENTION

The aspect of the embodiments is directed to suppressing a drop in the image quality of recording in overlapping portions in the case where a recording head including discharge port arrays obliquely arranged with respect to the width direction of the recording medium is used.

According to an aspect of the embodiments, a recording apparatus includes a recording head including a first discharge port array and a second discharge port array each including a plurality of recording elements configured to generate energy for discharging ink and a plurality of discharge ports provided to correspond to the recording elements, the first and second discharge port arrays being shifted and arranged in a first direction so that part of the discharge ports arranged at an end portion of the first discharge port array in the first direction and part of the discharge ports arranged at an end portion of the second discharge port array in the first direction are located at the same positions in the first direction, a moving unit configured to move at least either the recording head or a recording medium in a second direction crossing the first direction, and a control unit configured to control timing of discharge from the second discharge port array, wherein the plurality of discharge ports in each of the first and second discharge port arrays is obliquely arranged at a predetermined tilt with respect to the first direction, and wherein the control unit is configured to adjust the timing of discharge from the second discharge port array by a first adjustment amount according to the predetermined tilt so that the part of the discharge ports of the first discharge port array and the part of the discharge ports of the second discharge port discharge the ink to the same positions in the second direction on the recording medium.

Further features of the disclosure will become apparent from the following description of exemplary embodiments with reference to the attached drawings.

BRIEF DESCRIPTION OF THE DRAWINGS

FIGS. 6A and 6B are charts illustrating time-divisional driving order according to the exemplary embodiment.

FIGS. 8A and 8B are charts illustrating deviation amounts according to the exemplary embodiment.

FIGS. 10A and 10B are charts illustrating deviation amounts according to a comparative embodiment.

FIGS. 12A and 12B are charts illustrating deviation amounts according to a comparative embodiment.

FIGS. 14A-1, 14A-2, 14B-1, 14B-2, 14C-1, and 14C-2 are diagrams illustrating a tilt adjustment according to an exemplary embodiment.

FIGS. 15A and 15B are charts illustrating deviation amounts according to the exemplary embodiment.

FIGS. 17A and 17B are charts illustrating deviation amounts according to an exemplary embodiment.

FIGS. 19A and 19B are charts illustrating deviation amounts according to an exemplary embodiment.

FIGS. 21A and 21B are charts illustrating deviation amounts according to an exemplary embodiment.

DESCRIPTION OF THE EMBODIMENTS

Figure 1:
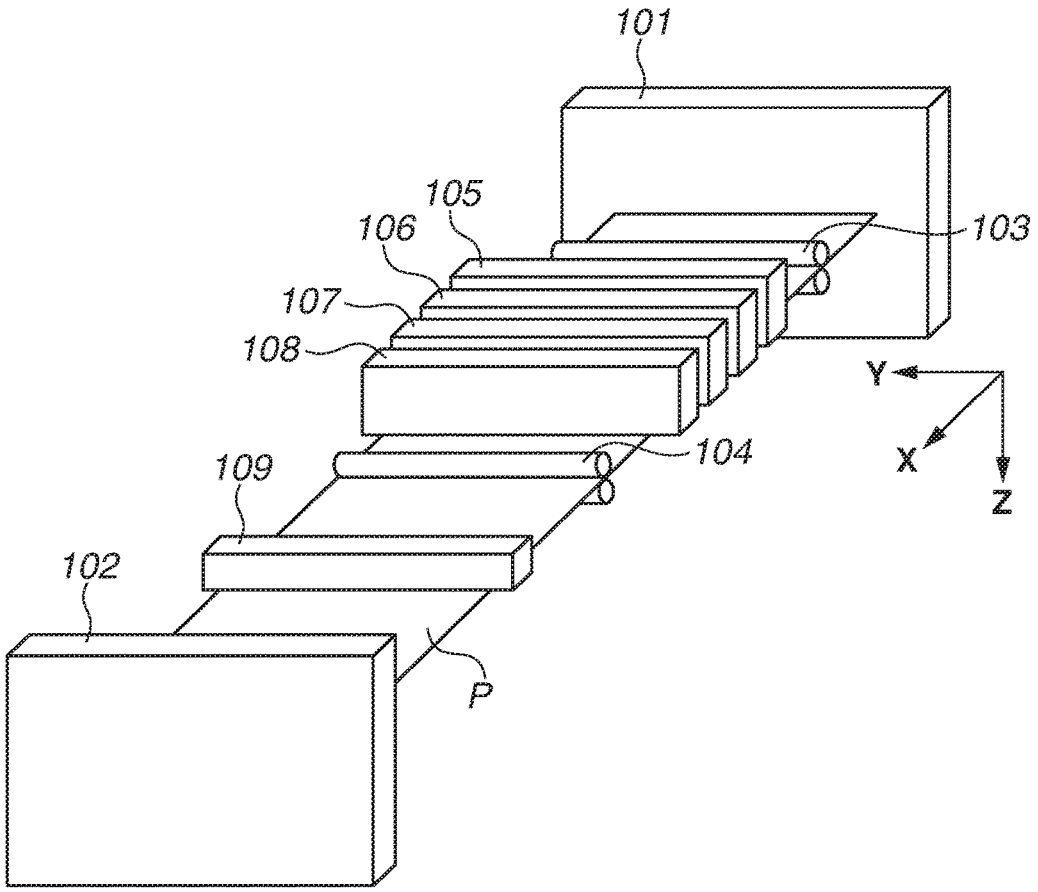
FIG. 1 is a diagram illustrating an internal configuration of a recording apparatus according to an exemplary embodiment.

A first exemplary embodiment will be described below. FIG. 1 is a diagram illustrating an internal configuration of an inkjet recording apparatus (hereinafter, also referred to as a recording apparatus) according to the present exemplary embodiment.

A recording medium P fed from a feeding unit 101 is sandwiched between conveyance roller pairs 103 and 104 and conveyed at a predetermined speed in a positive X direction (conveyance direction, crossing direction), and discharged to a discharge unit 102. Recording heads 105 to 108 are arranged along the conveyance direction between the upstream-side conveyance roller pair 103 and the downstream-side conveyance roller pair 104, and discharge ink in a positive Z direction according to recording data. The recording heads 105, 106, 107, and 108 discharge cyan, magenta, yellow, and black inks, respectively.

As employed herein, the recording data is data generated by performing various types of processing, such as color conversion processing and quantization processing, on image data that is expressed in red, green, and blue (RGB) values corresponding to an image to be recorded on the recording medium P. The recording data includes information defined pixel by pixel about whether to discharge ink for each pixel on the recording medium P.

In the present exemplary embodiment, the recording medium P may be a continuous sheet of paper which is held in a roll form in the feeding unit 101, or a cut sheet of paper which is cut in a standard size in advance. In the case of a continuous sheet, the recording medium P is cut in a predetermined length by a cutter 109 after the recording operation by the recording heads 105 to 108 ends. The discharge unit 102 sorts out recording media P by size onto respective discharge trays.

Figure 2:
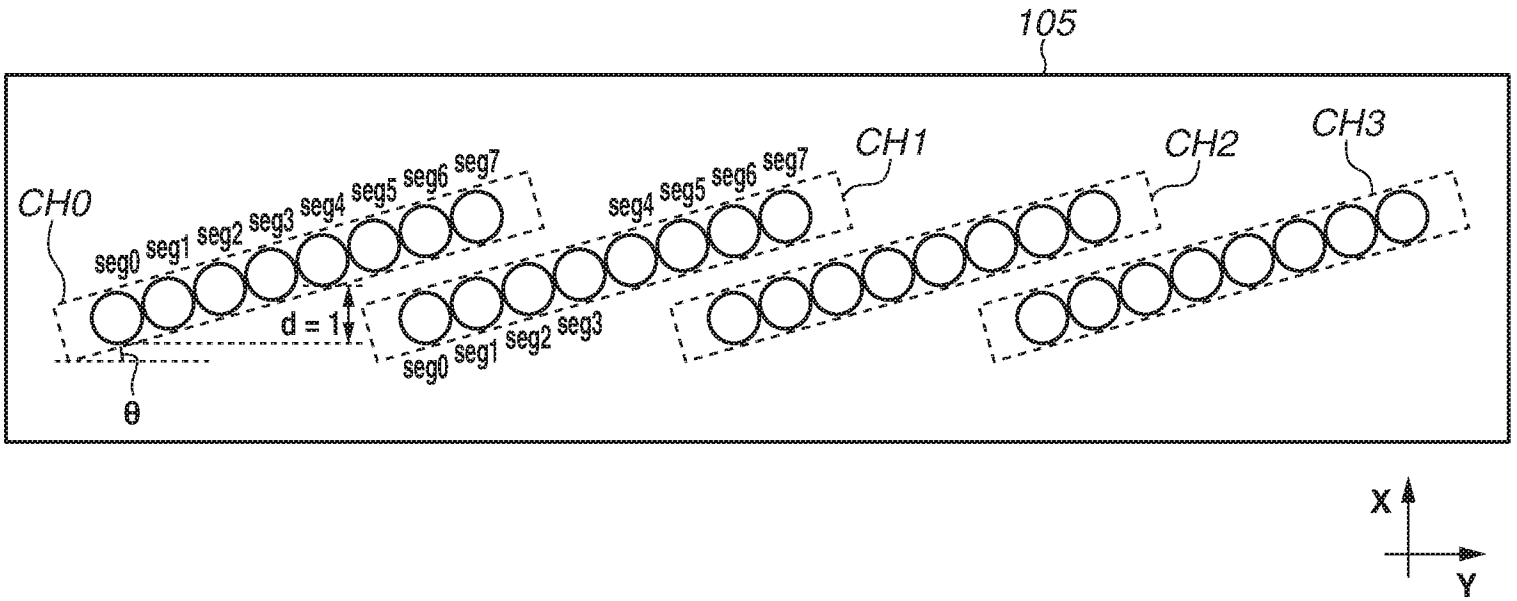
FIG. 2 is a diagram illustrating a recording head according to the exemplary embodiment.

FIG. 2 is a diagram illustrating a recording head according to the present exemplary embodiment. Here, FIG. 2 illustrates only the recording head 105 of cyan ink among the recording head 105 to 108. The other recording heads 106 to 108 have a similar configuration to that of the recording head 105.

The recording head 105 includes four chips CH0 to CH3 each including a discharge port array. The chips CH0 to CH3 include eight discharge ports seg0 to seg7 each. Recording elements (electrothermal conversion elements) are arranged at positions opposed to the respective discharge ports seg0 to seg7 of the chips CH0 to CH3 (inside the recording head 105). The recording elements are driven to generate energy and perform ink discharge operations. In the following description, for the sake of simplicity, the discharge ports and the recording elements inside may hereinafter be referred to collectively as discharge ports seg. For the sake of simplicity, the numerals of the discharge ports seg0 to seg7 may hereinafter be referred to as seg numbers.

In each of the chips CH0 to CH3, the discharge ports seg0 to seg7 are obliquely arranged at an angle of θ with respect to a Y direction (width direction of the recording medium P). Due to the tilt of θ in angle, the discharge ports seg0 to seg7 in the same discharge port array are located at different positions in the X direction (conveyance direction). For the sake of simplicity, a distance between the discharge ports seg0 and seg4 in each of the chips CH0 to CH3 in the X direction will hereinafter be denoted by d. In the present exemplary embodiment, the distance d corresponds to one pixel on the recording medium P (d=1).

In the recording head 105, the discharge port arrays are arranged so that some of the discharge ports of two discharge port arrays adjoining in the Y direction are located at the same positions in the Y direction to form an overlapping portion. For example, between the chips CH0 and CH1, the discharge ports seg6 and seg7 at the end of the chip CH0 in the positive Y direction and the discharge ports seg0 and seg1 at the end of the chip CH1 in the negative Y direction are located at the same positions to form an overlapping portion between the chips CH0 and CH1. Overlapping portions are similarly formed between the chips CH1 and CH2 and between the chips CH2 and CH3. For the sake of simplicity, the following description deals only with the overlapping portion between the chips CH0 and CH1.

Figure 3:
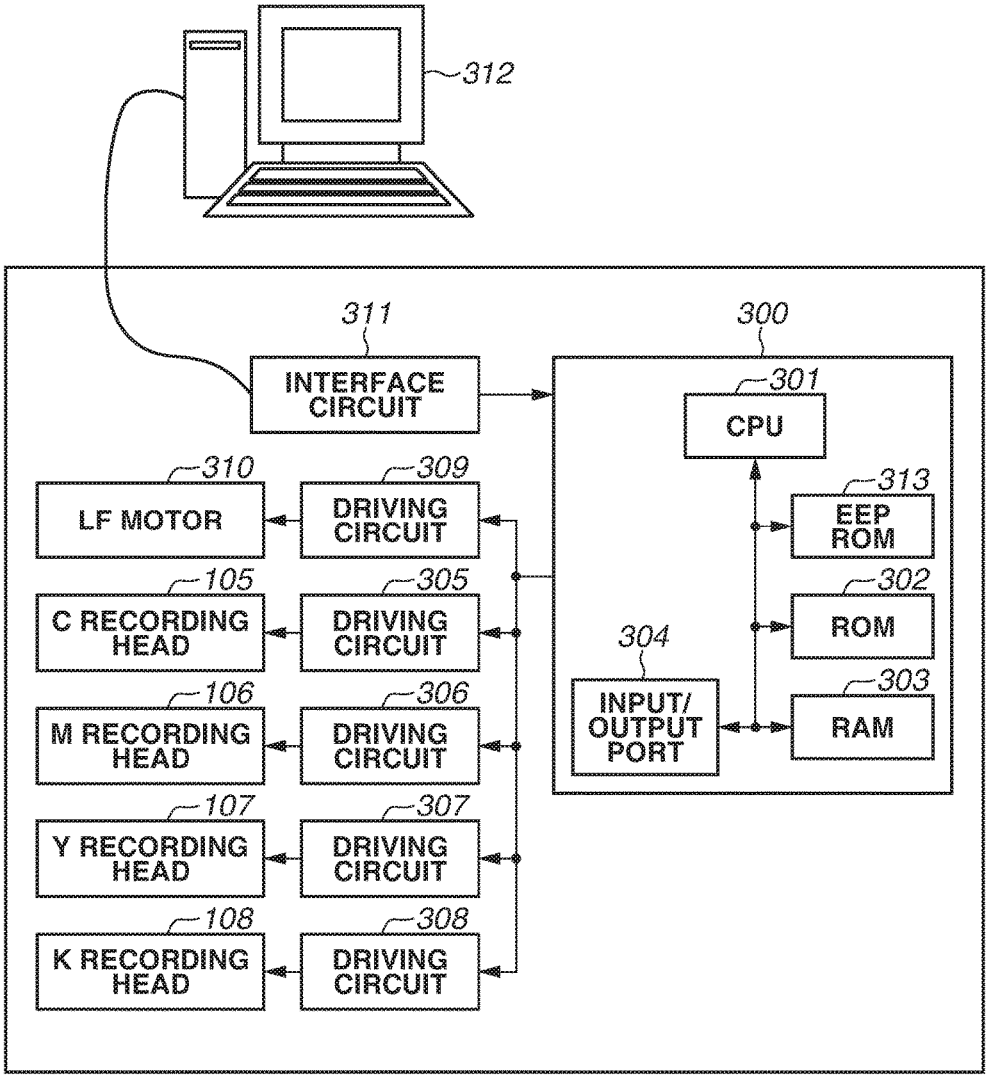
FIG. 3 is a diagram illustrating a recording control system according to the exemplary embodiment.

FIG. 3 is a block diagram illustrating a schematic configuration of a control system according to the present exemplary embodiment. A main control unit 300 includes a central processing unit (CPU) 301, a read-only memory (ROM) 302, a random access memory (RAM)303, an electrically erasable programmable read-only memory (EEPROM) 313, and an input/output port 304. The CPU 301 performs processing operations such as arithmetic, selection, determination, and control operations. The ROM 302 stores a control program to be executed by the CPU 301. The RAM 303 is used as a recording data buffer. The EEPROM 313 stores image data and mask patterns. The input/output port 304 is connected with driving circuits 309, 305, 306, 307, and 308 which correspond to a conveyance motor (line feed (LF) motor) 310, a cyan-ink recording head (C recording head) 105, a magenta-ink recording head (M recording head) 106, a yellow-ink recording head (Y recording head) 107, and a black-ink recording head (K recording head) 108. The main control unit 300 is further connected with a personal computer (PC) 312, which is a host computer, via an interface circuit 311.

(Impact Position Deviations of Dots and Adjustment Thereof)

Impaction position deviations of dots and an adjustment method according to the present exemplary embodiment will be described in detail below.

In the following description, for the sake of simplicity, the position of impact of a dot discharged from the discharge port seg0 of the chip CH0 in the X direction will be referred to as a reference position. A displacement of an impact position from the reference position in the X direction will be referred to as an impact position deviation amount.

1. Impact Position Deviations of Dots by Time-Divisional Driving

In the present exemplary embodiment, the discharge ports seg0 to seg7 belonging to the same chip is divided into a plurality of driving blocks and driven at respectively different timings for time-divisional driving so that the recording elements in the discharge ports seg0 to seg7 are not simultaneously driven. Here, the discharge ports seg0 to seg7 are described to constitute a single driving block each. The time-divisional driving suppresses simultaneous driving of the recording elements at the same timing, whereby the occurrence of excessive current can be suppressed.

If the time-divisional driving is performed, the impact positions of the dots from the discharge ports seg0 to seg7 deviate from each other.

Figure 4D:
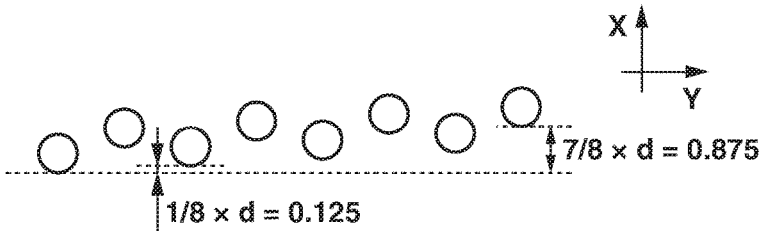
FIGS. 4A, 4B, 4C, and 4D are diagrams illustrating driving deviations due to time-divisional driving.
Figure 4C:
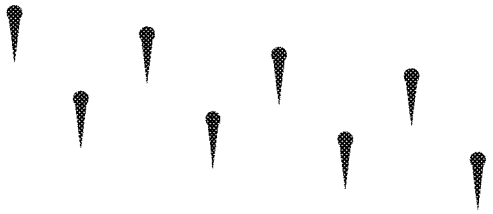
Figure 4B:
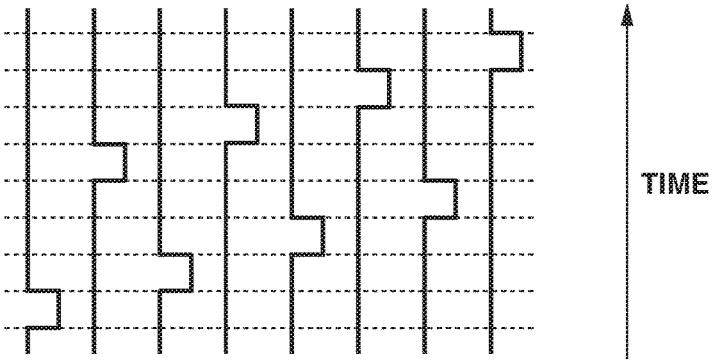
Figure 4A:
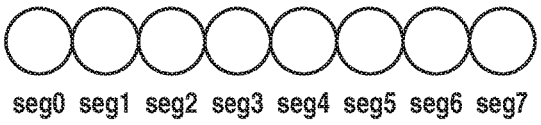

FIGS. 4A to 4D are diagrams illustrating the impact position deviations of the dots by time-divisional driving. To describe only the impact position deviations of the dots ascribable to the time-division driving, a discharge port array in which the discharge ports seg0 to seg7 are arranged in the Y direction as illustrated in FIG. 4A, though different from the discharge port arrays used in the exemplary embodiment, will be used for description.

Suppose that the discharge ports seg0, seg2, seg4, seg6, seg1, seg3, seg5, and seg7 are driven in such order. In other words, the order of driving of the discharge ports seg0 to seg7 is such that the discharge port seg0 is "1", the discharge port seg1 "5", the discharge port seg2 "2", the discharge port seg3 "6", the discharge port seg4 "3", the discharge port seg5 "7", the discharge port seg6 "4", and the discharge port seg7 "8". In the following description, the transition of the order of driving as the seg number increases one by one will be referred to as driving order. In the foregoing case, the driving order of the discharge ports seg0 to seg7 is 1, 5, 2, 6, 3, 7, 4, and 8.

If the discharge ports seg0 to seg7 are driven in the foregoing driving order, as illustrated in FIG. 4B, a pulse is initially applied to the discharge port seg0 for driving. Pulses are then similarly applied to the discharge ports seg2, seg4, seg6, seg1, seg3, seg5, and seg7 in such order, whereby the discharge ports seg2, seg4, seg6, seg1, seg3, seg5, and seg7 are sequentially driven. As a result, dots impact on the recording medium P in order of the discharge ports seg0, seg2, seg4, seg6, seg1, seg3, seg5, and seg7 (FIG. 4C).

The recording medium P is being conveyed in the positive X direction even while the discharge ports seg0 to seg7 are sequentially driven. Since the time-divisional driving shifts the driving timing for each discharge port, the dots discharged from the respective discharge port seg0 to seg7 deviate in the X direction by distances according to the conveyance speed of the recording medium P. In the following description, the conveyance speed is described to be such that a distance of separation between dots in the X direction is 1/8×d(=0.125) if the driving timing is shifted by one.

FIG. 4D is a diagram illustrating the positions of impact of the dots from the respective discharge ports seg0 to seg7 when time-divisional driving is performed under the foregoing condition. The dot from the discharge port seg0 driven at the earliest driving timing impacts on a position closest to the negative X side. Next, the discharge port seg2 is driven, and the dot from the discharge port seg2 impacts on a position deviated by 1/8×d(=0.125) in the positive X direction from the dot from the discharge port seg0 (reference position). Next, the discharge port seg4 is driven, and the dot impacts on a position deviated by 2/8×d(=0.25) in the positive X direction from the reference position. Similarly, the impact position of a dot on the recording medium P deviates by 1/8×d(=0.125) in the positive X direction each time the driving timing is delayed by one. The dot from the discharge port seg7 which is driven at the latest timing impacts on a position closest to the positive X direction side. The impact position is deviated by 7/8×d(=0.875) in the X direction from the reference position.

If the time-divisional driving is performed, a dot thus impacts on a position deviated by 1/8×d(=0.125) in the positive X direction each time the driving timing is delayed by one.

2. Impact Position Deviations of Dots Due to Tilt of Discharge Port Array

As described with reference to FIG. 2, the present exemplary embodiment uses the discharge port arrays in which the discharge ports seg0 to seg7 are arranged in a direction tilted by an angle of θ with respect to the Y direction. The impact positions of the dots from the discharge ports seg0 to seg7 also deviate from each other due to the tilt of the discharge port arrays.

FIG. 5 is a diagram illustrating impact position deviations of dots due to the tilt of a discharge port array. To describe only the impact position deviations of the dots ascribable to the tilt of the discharge port array, the discharge ports seg0 to 7 are described to be, unlike the exemplary embodiment, simultaneously driven.

Figure 5C:
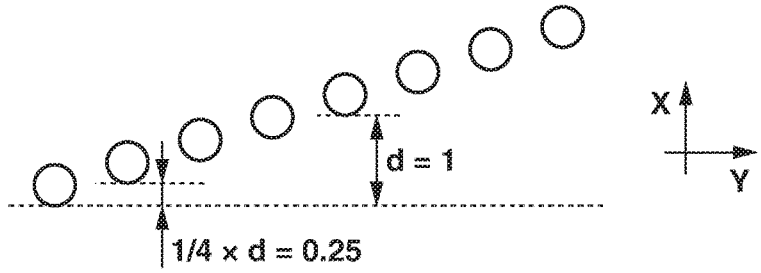
FIGS. 5A, 5B, and 5C are diagrams illustrating tilt deviations due to a tilt of a discharge port array.
Figure 5B:
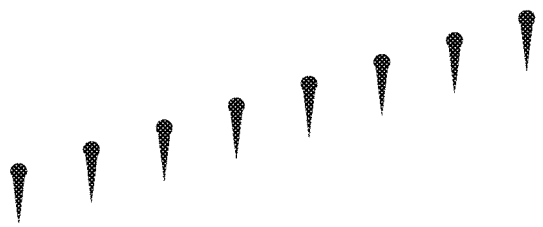
Figure 5A:
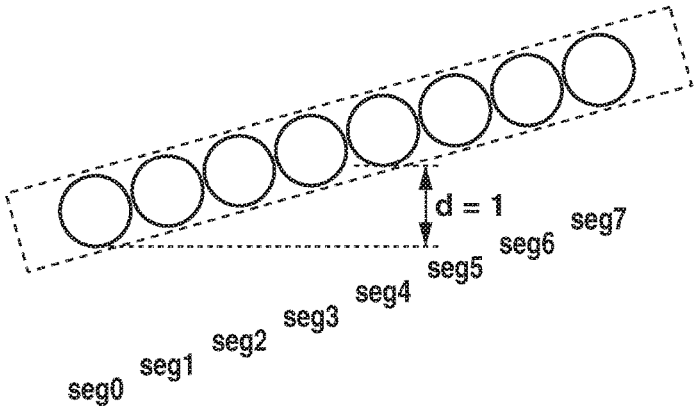

As described above, in the present exemplary embodiment, the distance between the discharge ports seg0 and seg4 in the X direction is d(=1) (FIG. 5A). A distance between adjoining discharge ports, e.g., between the discharge ports seg0 and seg1 in the X direction, is thus 1/4×d(=0.25). If such a discharge port array is used and the discharge ports seg0 to seg7 are simultaneous driven (FIG. 5B), the tilt of the discharge port array is directly reflected on the impact positions of the dots.

FIG. 5C is a diagram illustrating the impact positions of the dots from the respective discharge ports seg0 to seg7 when simultaneous driving is performed by using the discharge port array tilted at an angle of θ. The dot from the discharge port seg0 impacts on a position closest to the negative X direction side. A dot impacts on a position deviated by 1/4×d(=0.25) in the positive X direction each time the seg number increases. The dot from the discharge port seg7 impacts on a position farthest in the positive X direction. This dot impacts on a position deviated by 7/4×d=(1.75) in the positive X direction from the reference position.

If such a tilted discharge port array is used, a dot thus impacts on a position deviated by 1/4×d(=0.25) in the positive X direction each time the seg number increases.

3. Adjustment of Chip-to-Chip Impact Position Deviations by Offsetting of Driving Order If there occur dot impact position deviations due to the foregoing time-divisional driving and the tilt of the discharge port arrays, image quality drops in the overlapping portion between the chips. Then, in the present exemplary embodiment, the driving order in either one of the chips is offset so that the discharge ports that form the same overlapping portion between the chips are driven in the same order. The effect of the dot impact position deviations due to the time-divisional driving in the overlapping portion can be cancelled by such control.

FIG. 6A illustrates the driving order when the discharge ports seg0 to seg7 of the chip CH0 are time-divisionally driven according to the present exemplary embodiment. The discharge ports seg0 to seg7 of the chip CH0 are time-divisionally driven in the driving order of 1, 5, 2, 6, 3, 7, 4, and 8. Such driving order is the same as that described in FIGS. 4A to 4D.

FIG. 6B illustrates the driving order when the discharge ports seg0 to seg7 of the chip CH1 are time-divisionally driven according to the present exemplary embodiment. In the present exemplary embodiment, the driving order of the chip CH0 is offset by an amount such that the discharge ports seg0 and seg1 of the chip CH1 forming an overlapping portion are driven in the same order as that in which the discharge ports seg6 and seg7 of the chip CH0 forming the same overlapping portion are driven. The offset driving order is used as the driving order of the chip CH1.

As illustrated in FIG. 6A, the order in which the discharge ports seg6 and seg7 of the chip CH0 are driven is the fourth and eighth, respectively. The driving order of the chip CH0 is then offset backward by two so that the order in which the discharge ports seg0 and seg1 of the chip CH1 are driven is also the fourth and eighth, respectively. As a result of the offsetting, the driving order of 4, 8, 1, 5, 2, 6, 3, and 7 is obtained. Such driving order is used as the driving order of the chip CH1.

By offsetting the driving order of the chip CH0 to obtain the driving order of the chip CH1, the order of driving of the discharge ports seg6 and seg7 of the chip CH0 and that of the discharge ports seg0 and seg1 of the chip CH1 forming the overlapping portion can be made the same, i.e., the fourth and eighth. This can reduce the impact position deviations of the dots between the chips CH0 and CH1 due to the time-divisional driving in the overlapping portion.

4. Adjustment of Chip-to-Chip Impact Position Deviations by Chip-to-Chip Pulse Delay As described above, the driving order can be offset to suppress the impact position deviations of the dots due to the time-divisional driving in the overlapping portion between two chips, but not the impact position deviations of the dots due to the tilt of the discharge port arrays.

For example, the amounts of deviation of the discharge ports seg6 and seg7 of the chip CH0 forming one side of the overlapping portion, due to the tilt of the discharge port array are respectively 6/4×d(=1.5) and 7/4×d(=1.75) in the positive X direction from the reference position. The amounts of deviation of the discharge ports seg0 and seg1 of the chip CH1 forming the other side of the overlapping portion, due to the tilt of the discharge port array are respectively 0/4×d(=0) and 1/4×d(=0.25) in the positive X direction from the reference position. In other words, impact position deviation of 1.5(=1.5−0, and =1.75−0.25) occur between the chips CH0 and CH1 due to the tilt of the discharge port arrays.

In view of the foregoing, in the present exemplary embodiment, the timing to apply the driving pulses to the chip CH1 is delayed by a time equivalent to 1.5 pixels, compared to the timing to apply the driving pulses to the chip CH0. In the following description, this will be referred to as a pulse delay control.

The amount of delay (pulse delay amount) by the pulse delay control can be set to various values as appropriate. In the present exemplary embodiment, the timing is delayed by the time equivalent to 1.5 pixels. However, for example, the timing may be delayed by a time equivalent to 0.5 pixel or a time equivalent to 3.0 pixels. The pulse delay amount is not limited to integer multiples of the pixel size of the recording data (such as 3.0 pixels), and may be set to amounts other than integer multiples of the pixel size of the recording data (such as 1.5 pixels and 0.5 pixel). The timing not only can be delayed, but may be advanced.

In the pulse delay control in one embodiment, all the discharge ports belonging to the same chip (discharge port array) are to be delayed by the same amount. The reason for such a limitation is that the signal for delaying is transmitted to the plurality of recording elements in the discharge ports belonging to the same chip via common wiring, and the pulse delay amount is thus unable to be changed for each recording element.

Figure 7C:
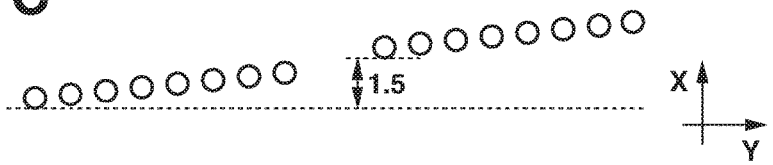
FIGS. 7A, 7B, and 7C are diagrams illustrating pulse delay according to the exemplary embodiment.
Figure 7B:
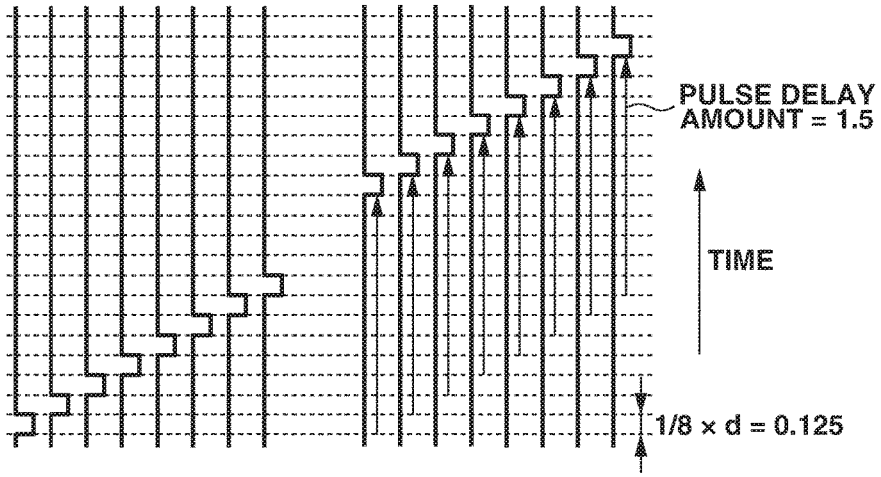
Figure 7A:
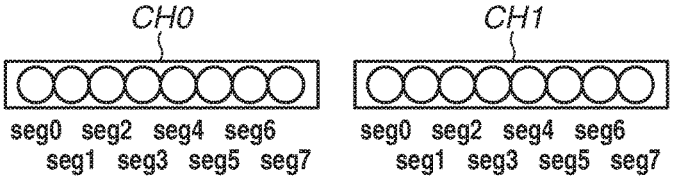
Figure 23C:
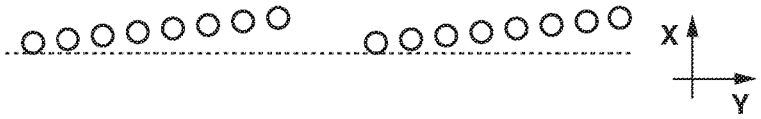
FIGS. 23A, 23B, and 23C are diagrams illustrating pulse delay according to an exemplary embodiment.
Figure 23B:
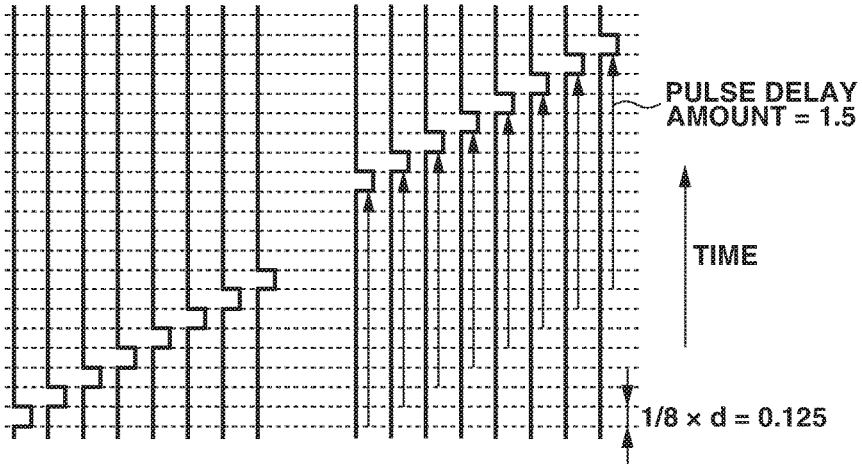
Figure 23A:
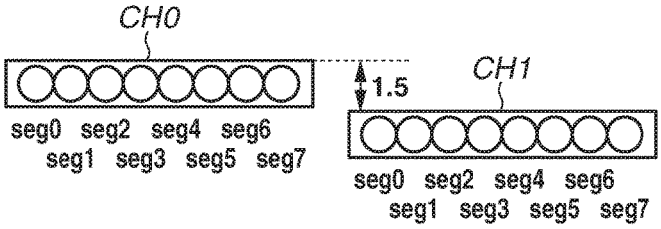

FIGS. 7A to 7C and 23A to 23C are diagrams illustrating the pulse delay control. For the sake of simplicity, the following description deals with a case where discharge port arrays (FIGS. 7A and 23A) in which discharge ports seg0 to seg7 are arranged along the Y direction (not tilted with respect to the Y direction) are used and the driving order of the discharge ports seg0 to seg7 is 1, 2, 3, 4, 5, 6, 7, and 8 (FIGS. 7B and 23B), respectively. FIGS. 7A to 7C illustrate a case where, like the present exemplary embodiment, no pulse delay control is performed on the chip CH0 and a pulse delay control of 1.5 pixels is performed on the chip CH1. FIGS. 7A to 7C illustrate a case where the chips CH0 and CH1 are provided at the same position in the X direction. FIGS. 23A to 23C illustrate a case where the chips CH0 and CH1 are provided at positions shifted in the X direction.

As illustrated in FIG. 7B and 23B, in the present exemplary embodiment, the driving timing of the discharge ports seg0 to seg7 of the chip CH1 is delayed as much as 1.5 pixels, compared to that of the discharge ports seg0 to seg7 of the chip CH0.

If the chips CH0 and CH1 are provided at the same position in the X direction, as illustrated in FIG. 7C, the dots formed by the discharge ports seg0 to seg7 of the chip CH1 therefore impact on positions deviated by 1.5 pixels in the positive X direction from the dots formed by the discharge ports seg0 to seg7 of the chip CH0.

FIG. 23A illustrates the case where the chip CH1 is provided at the position shifted by 1.5 pixels in the negative X direction from the chip CH0. In such a case, as illustrated in FIG. 23C, the dots formed by the discharge ports seg0 to seg7 of the chip CH1 and the dots formed by the discharge ports seg0 to seg7 of the chip CH0 impact on the same positions in the X direction.

In the present exemplary embodiment, the foregoing pulse delay control is performed to reduce the impact position deviations of the dots due to the tilt of the discharge port arrays in the overlapping portion.

5. Chip-to-Chip Impact Positions According to First Exemplary Embodiment

FIG. 8A is a chart illustrating the dot impact positions of the chip CH0 according to the present exemplary embodiment. FIG. 8B is a chart illustrating the dot impact positions of the chip CH1 according to the present exemplary embodiment.

In the following description, for the sake of simplicity, coordinates are set and described according to the positions of the discharge ports forming the respective dots in the Y direction. The coordinate is described to increase as the position moves in the positive Y direction. More specifically, the coordinate of the dot formed by the discharge port seg0 of the chip CH0 is "0". Similarly, the coordinates of the dots formed by the discharge ports seg1 to seg5 of the chip CH0 are "1" to "5", respectively. The coordinates of the dots formed by the discharge port seg6 of the chip CH0 and the discharge port seg0 of the chip CH1 are "6" since the discharge ports are located at the same position in the Y direction. The coordinates of the dots formed by the discharge port seg7 of the chip CH0 and the discharge port seg1 of the chip CH1 are "7" since the discharge ports are located at the same position in the Y direction. The coordinates of the dots formed by the discharge ports seg2 to seg7 of the chip CH1 are "8" to "13", respectively.

The chip CH0 will initially be described.

As described above, the amount of impact position deviation due to the time-divisional driving (hereinafter, also referred to as driving deviation amount) increases by 1/8×d(=0.125) each time the order of driving increases by one. The discharge ports seg0 to seg7 are driven in the driving order of 1, 5, 2, 6, 3, 7, 4, and 8. A "driving deviation amount" field of FIG. 8A illustrates the driving deviation amounts.

As described above, the amount of deviation due to the tilt of the discharge port array (hereinafter, also referred to as a tilt deviation amount) increases by 1/4×d(=0.25) each time the seg number increases by one. A "tilt deviation amount" field of FIG. 8A illustrates the tilt deviation amounts.

The amounts of deviation (dot impact positions) from the reference position in the chip CH0 are the sums of the driving deviation amounts and the tilt deviation amounts of the respective discharge ports seg0 to seg7 in the chip CH0. Specifically, a "total deviation amount" field of FIG. 8A illustrates the amounts of deviation (dot impact positions) of the respective discharge ports seg0 to seg7 of the chip CH0 from the reference position.

Next, the chip CH1 will be described.

As described above, the discharge ports seg0 to seg7 of the chip CH1 are driven in the driving order of 4, 8, 1, 5, 2, 6, 3, and 7. The "driving deviation amount" field of FIG. 8B illustrates the driving deviation amounts.

Since the discharge port arrays of the chips CH0 and CH1 have the same tilt, the tilt deviation amounts of the chip CH1 are the same as those of the chip CH0 as illustrated in the "tilt deviation amount" field of FIG. 8B.

In the present exemplary embodiment, the pulse delay control is performed on the chip CH1 as described above. Here, the application timing of the driving pulses is shifted so that the impact positions of the dots from the chip CH1 are shifted by 1.5 pixels in the positive X direction from those of the chip CH0 as described above. The impact positions of the dots of the chip CH1 thus deviate as much as the "driving deviation amounts" and the "tilt deviation amounts" plus the "pulse delay amounts" of FIG. 8B. The "total amount of deviation" field of FIG. 8B illustrates the amounts of deviation (dot impact positions) of the respective discharge ports seg0 to seg7 of the chip CH1 from the reference position.

Focusing attention on the discharge ports seg6 and seg7 of the chip CH0 and the discharge ports seg0 and seg1 of the chip CH1 which form the overlapping portion, the impact positions of the dots from the discharge ports will be described in detail.

The discharge ports seg6 and seg7 of the chip CH0 are driven by the time-divisional driving so that the discharge port seg6 is the fourth and the discharge port seg7 the eighth in the driving order. The discharge port seg6 thus has a driving deviation amount of 3/8×d(=0.375), and the discharge port seg7 a driving deviation amount of 7/8×d (=0.875). The discharge port seg6 has a tilt deviation amount of 6/4×d(=1.5), and the discharge port seg7 a tilt deviation amount of 7/4×d(=1.75).

Consequently, as illustrated in the "total amount of deviation" field of FIG. 8A, the impact positions of the dots from the discharge ports seg6 and seg7 of the chip CH0 are 1.875(=0.375+1.5) for the discharge port seg6 and 2.625 (=0.875+1.75) for the discharge port seg7.

The discharge ports seg0 and seg1 of the chip CH1 are driven by the time-divisional driving so that the discharge port seg0 is the fourth and the discharge port seg1 the eighth in the driving order. The discharge port seg0 has a driving deviation amount of 3/8×d(=0.375), and the discharge port seg1 a driving deviation amount of 7/8×d(=0.875). The discharge port seg0 has a tilt deviation amount of 0/4×d(=0), and the discharge port seg1 a tilt deviation amount of 1/4×d(=0.25). As described above, the pulse delay control is also performed on the chip CH1. The amount of deviation by the pulse delay control is 1.5 for both the discharge ports seg0 and seg1.

Consequently, as illustrated in the "total amount of deviation" field of FIG. 8B, the impact positions of the dots from the discharge ports seg0 and seg1 of the chip CH1 are 1.875(=0.375+0+1.5) for the discharge port seg0 and 2.625 (=0.875+0.25+1.5) for the discharge port seg1.

In summary, the dot impact positions of both the discharge port seg6 of the chip CH0 and the discharge port seg0 of the chip CH1 are 1.875. The dot impact positions of both the discharge port seg7 of the chip CH0 and the discharge port seg1 of the chip CH1 are 2.625. Since the impact positions of the dots of the chips CH0 and CH1 forming the overlapping portion can be made the same, a drop in the image quality in the overlapping portion can be suppressed.

Figure 9:
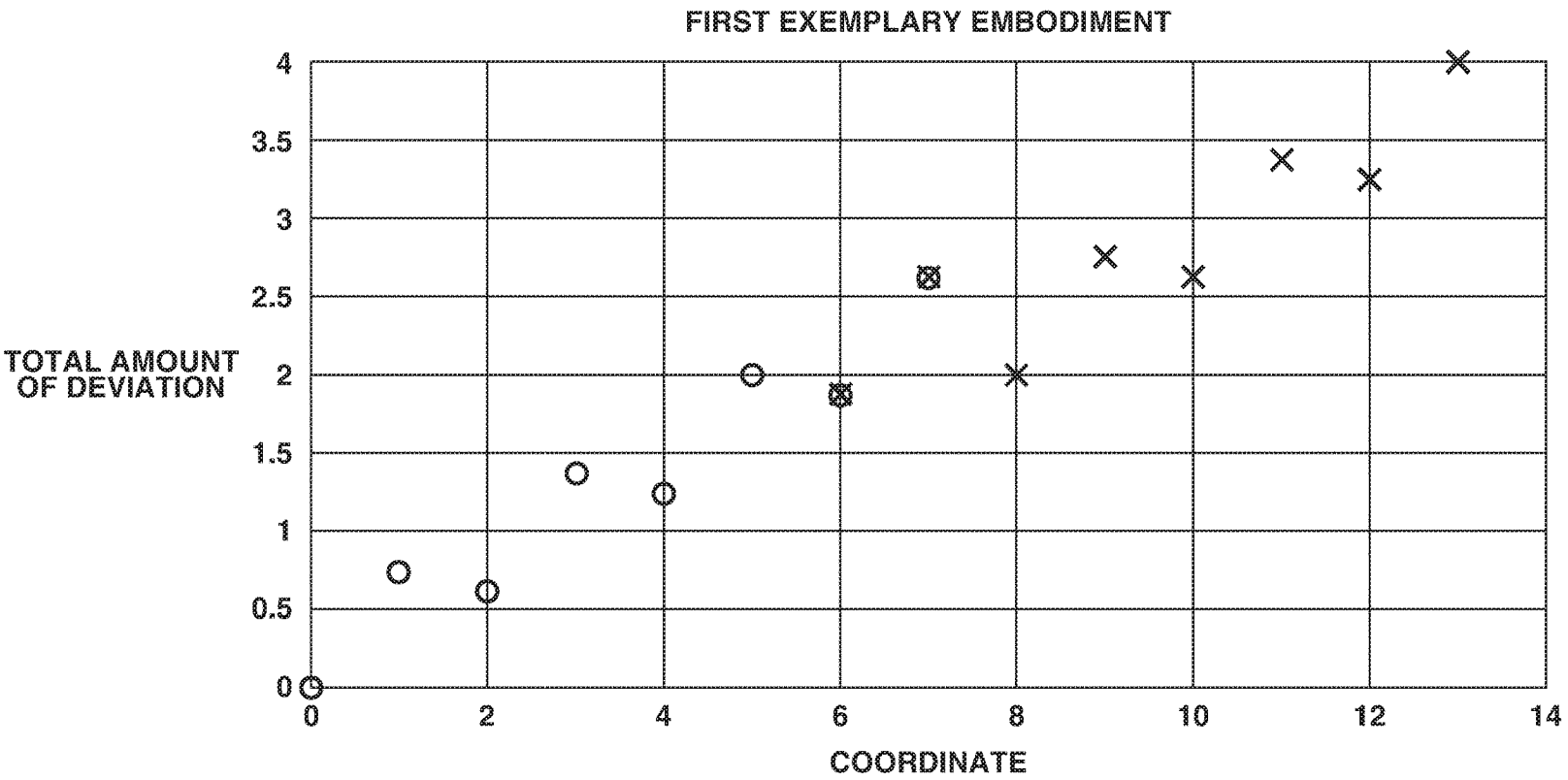
FIG. 9 is a chart illustrating a total amount of deviation according to the exemplary embodiment.

FIG. 9 is a chart illustrating the correlation between the coordinate and the dot impact position in the case where the present exemplary embodiment is applied. The horizontal axis of FIG. 9 indicates the coordinates illustrated in FIGS. 8A and 8B. The vertical axis of FIG. 9 indicates the total amounts of deviation (dot impact positions) illustrated in FIGS. 8A and 8B. Marks ○ represent the impact positions of the dots from the chip CH0. Marks × represent the impact positions of the dots from the chip CH1.

As can be seen from FIG. 9, if the present exemplary embodiment is used, the marks ○ and × overlap at the coordinate "6" corresponding to the discharge port seg6 of the chip CH0 and the discharge port seg0 of the chip CH1, and at the coordinate "7" corresponding to the discharge port seg7 of the chip CH0 and the discharge port seg1 of the chip CH1. In other words, according to the present exemplary embodiment, the impact positions of the chips CH0 and CH1 can be made the same at the coordinates "6" and "7".

Next, a first comparative embodiment which is a comparative example of the first exemplary embodiment will be described. A description of parts similar to those of the first exemplary embodiment will be omitted.

In the first comparative embodiment, neither the offsetting of the driving order nor the chip-to-chip pulse delay control is performed.

FIG. 10A is a chart illustrating the dot impact positions of the chip CH0 according to the first comparative embodiment. FIG. 10B is a chart illustrating the dot impact positions of the chip CH1 according to the first comparative embodiment.

The chip CH0 will initially be described.

In the first comparative embodiment, like the first exemplary embodiment, neither the offsetting of the driving order nor the chip-to-chip pulse delay control is performed on the chip CH0. As illustrated in FIG. 10A, the deviation amounts (the driving deviation amounts, the tilt deviation amounts, and the total amounts of deviation) are the same as those of the first exemplary embodiment illustrated in FIG. 8A.

Next, the chip CH1 will be described.

Unlike the first exemplary embodiment, the offsetting of the driving order is not performed on the chip CH1. The discharge ports seg0 to seg7 are therefore driven in the driving order of 1, 5, 2, 6, 3, 7, 4, and 8, as with the chip CH0. The "driving deviation amount" field of FIG. 10B illustrates the driving deviation amounts. Since the chips CH0 and CH1 according to the first comparative embodiment have the same driving order, the "driving deviation amounts" of the chips CH0 and CH1 are also the same.

The discharge port arrays of the chips CH0 and CH1 have the same tilt. As illustrated in the "tilt deviation amount" field of FIG. 10B, the tilt deviation amounts of the chip CH1 are therefore the same as those of the chip CH0 illustrated in FIG. 10A.

In the present comparative embodiment, the chip-to-chip pulse delay control is not performed. The total amounts of deviation are therefore the sums of the driving deviation amounts and the tilt deviation amounts of the respective discharge ports seg0 to seg7 in the chip CH1. The "total amount of deviation" field of FIG. 10B illustrates the specific values.

Next, focusing attention on the discharge ports seg6 and seg7 of the chip CH0 and the discharge ports seg0 and seg1 of the chip CH1 which form an overlapping portion, the impact positions of the dots from the discharge ports will be described in detail.

The discharge ports seg6 and seg7 of the chip CH0 are driven by the time-divisional driving so that the discharge port seg6 is the fourth and the discharge port seg7 the eighth in the driving order. The discharge port seg6 thus has a driving deviation amount of 3/8×d(=0.375), and the discharge port seg7 a driving deviation amount of 7/8×d (=0.875). The discharge port seg6 has a tilt deviation amount of 6/4×d(=1.5), and the discharge port seg7 a tilt deviation amount of 7/4×d(=1.75).

As illustrated in the "total amount of deviation" field of FIG. 10A, the impact positions of the dots from the discharge ports seg6 and seg7 of the chip CH0 are 1.875 (=0.375+1.5) for the discharge port seg6 and 2.625(=0.875+1.75) for the discharge port seg7.

The discharge ports seg0 and seg1 of the chip CH1 are driven by the time-divisional driving so that the discharge port seg0 is the first and the discharge port seg1 the fifth in the driving order. The discharge port seg0 thus has a driving deviation amount of 0/8×d(=0), and the discharge port seg1 a driving deviation amount of 4/8×d(=0.5). The discharge port seg0 has a tilt discharge amount of 0/4×d(=0), and the discharge port seg1 a tilt discharge amount of 1/4×d(=0.25).

As illustrated in the "total amount of deviation" field of FIG. 10B, the impact positions of the dots from the discharge ports seg0 and seg1 of the chip CH1 are 0(=0+0) for the discharge port seg0 and 0.75(=0.5+0.25) for the discharge port seg1.

In other words, in the overlapping portion, the discharge port seg6 of the chip CH0 has a dot impact position of 1.875 and the discharge port seg0 of the chip CH1 a dot impact position of 0. Although corresponding to the discharge ports located at the same position in the Y direction, the dots are formed at different positions in the X direction. The discharge port seg7 of chip CH0 has a dot impact position of 2.625, and the discharge port seg0 of the chip CH1 a dot impact position of 0.75. Again, although corresponding to the discharge ports located at the same position in the Y direction, the dots are formed at different positions in the X direction. The first comparative embodiment is therefore not able to make the impact positions of the dots the same between the chips CH0 and CH1 forming the overlapping portion. This causes a drop in the image quality.

Figure 11:
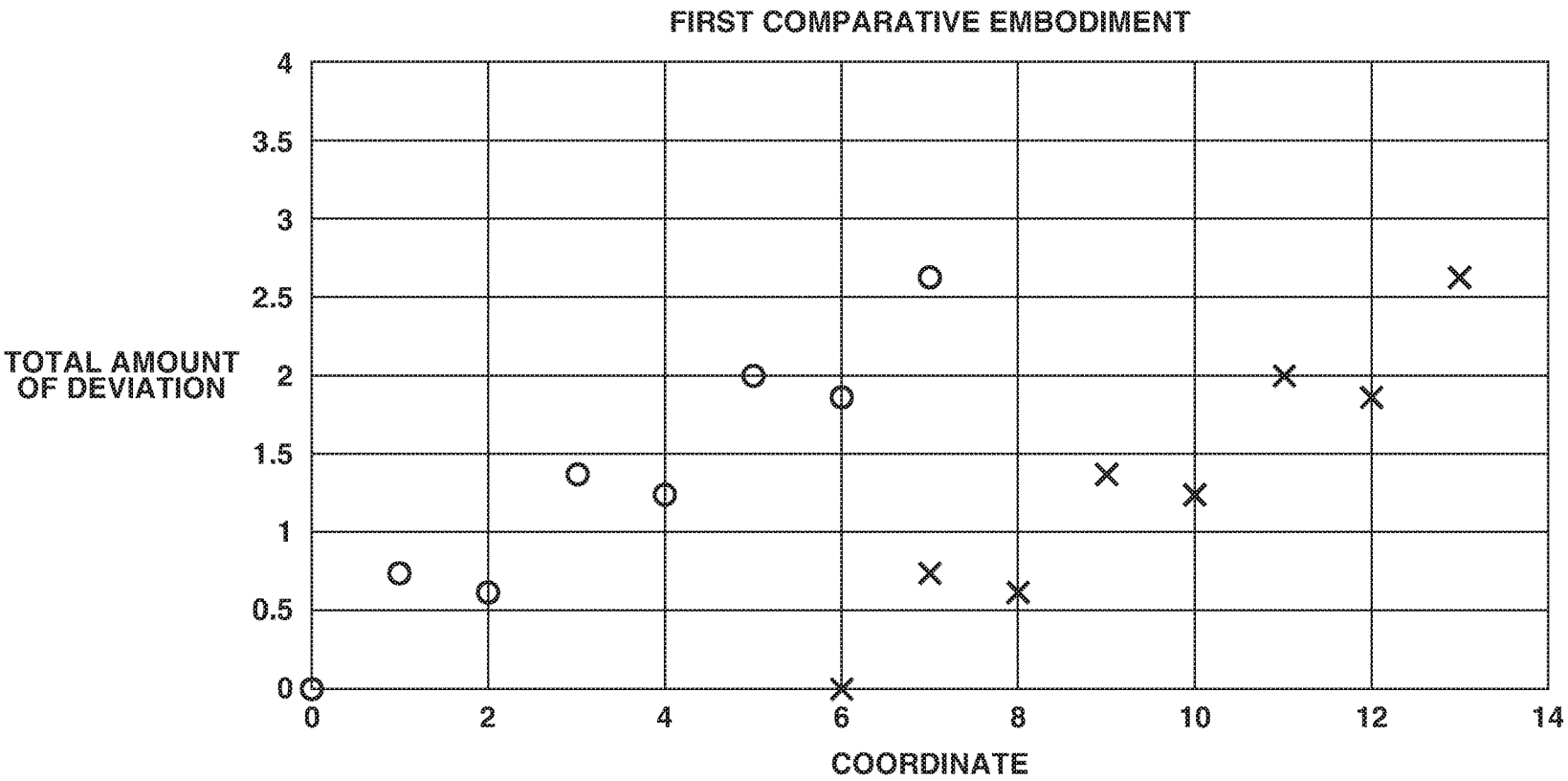
FIG. 11 is a chart illustrating a total amount of deviation according to the comparative embodiment.

FIG. 11 is a chart illustrating the correlation between the coordinate and the dot impact position in the case where the first comparative embodiment is applied. The horizontal axis of FIG. 11 indicates the coordinates illustrated in FIGS. 10A and 10B. The vertical axis indicates the total amounts of deviation (dot impact positions) illustrated in FIGS. 10A and 10B. The marks ○ represent the impact positions of the dots from the chip CH0. The marks × represent the impact positions of the dots from the chip CH1.

As can be seen from FIG. 11, if the first comparative embodiment is used, the marks ○ and × do not overlap even at the coordinate "6" corresponding to the discharge port seg6 of the chip CH0 and the discharge port seg0 of the chip CH1 or at the coordinate "7" corresponding to the discharge port seg7 of the chip CH0 and the discharge port seg1 of the chip CH1, i.e., fall on different positions. In the first comparative embodiment, the impact positions of the dots of the chips CH0 and CH1 thus differ at the coordinates "6" and "7" corresponding to the overlapping portion.

Next, a second comparative embodiment which is a comparative example of the first exemplary embodiment will be described. A description of parts similar to those of the first comparative embodiment will be omitted.

In the second comparative embodiment, the offsetting of the driving order is performed as in the first exemplary embodiment, but not the chip-to-chip pulse delay control.

FIG. 12A is a chart illustrating the dot impact positions of the chip CH0 according to the second comparative embodiment. FIG. 12B is a chart illustrating the dot impact positions of the chip CH1 according to the second comparative embodiment.

The chip CH0 will initially be described.

In the second comparative embodiment, like the first exemplary embodiment and the first comparative embodiment, neither the offsetting of the driving order nor the chip-to-chip pulse delay control is performed on the chip CH0. As illustrated in FIG. 12A, the deviation amounts (the driving deviation amounts, the tilt deviation amounts, and the total amounts of deviation) are therefore the same as those of the first exemplary embodiment illustrated in FIG. 8A and the first comparative embodiment illustrated in FIG. 10A.

Next, the chip CH1 will be described.

Like the first exemplary embodiment, the offsetting of the driving order is performed on the chip CH1 so that the discharge ports seg0 and seg1 of the chip CH1 are driven in the same order as that of the discharge ports seg6 and seg7 of the chip CH0. Specifically, the driving order of the chip CH1 is 4, 8, 1, 5, 2, 6, 3, and 7, which is the driving order of the chip CH0 offset backward by two. The "driving deviation amount" field of FIG. 12B illustrates the driving deviation amounts. The "driving deviation amounts" are the same as the "driving deviation amounts" according to the first exemplary embodiment illustrated in FIG. 8B.

The discharge port arrays of the chips CH0 and CH1 have the same tilt. As illustrated in the "tilt deviation amount" field of FIG. 12B, the tilt deviation amounts of the chip CH1 are the same as those of the chip CH0 illustrated in FIG. 12A.

Since the chip-to-chip pulse delay control is not performed in the present comparative embodiment, the total amounts of deviation are the sums of the driving deviation amounts and the tilt deviation amounts of the respective discharge ports seg0 to seg7 in the chip CH1. The "total amount of deviation" field of FIG. 12B illustrates the specific values.

Next, focusing attention on the discharge ports seg6 and seg7 of the chip CH0 and the discharge ports seg0 and seg1 of the chip CH1 which form the overlapping portion, the impact positions of the dots from the discharge ports will be described in detail.

The discharge ports seg6 and seg7 of the chip CH0 are driven by the time-divisional driving so that the discharge port seg6 is the fourth and the discharge port seg7 the eighth in the driving order. The discharge port seg6 thus has a driving deviation amount of 3/8×d(=0.375), and the discharge port seg7 a driving deviation amount of 7/8×d (=0.875). The discharge port seg6 has a tilt deviation amount of 6/4×d(=1.5), and the discharge port seg7 a tilt deviation amount of 7/4×d(=1.75).

Consequently, as illustrated in the "total amount of deviation" field of FIG. 12A, the impact positions of the dots from the discharge ports seg6 and seg7 of the chip CH0 are 1.875(=0.375+1.5) for the discharge port seg6 and 2.625 (=0.875+1.75) for the discharge port seg7.

The discharge ports seg0 and seg1 of the chip CH1 on which the offsetting of the driving order is performed are driven by the time-divisional driving so that the discharge port seg0 is the fourth and the discharge port seg1 the eighth in the driving order. The discharge port seg0 thus has a driving deviation amount of 3/8×d(=0.375), and the discharge port seg1 a driving deviation amount of 7/8×d (=0.875). The discharge port seg0 has a tilt deviation amount of 0/4×d(=0), and the discharge port seg1 a tilt deviation amount of 1/4×d(=0.25).

Consequently, as illustrated in the "total amount of deviation" field of FIG. 12B, the impact positions of the dots from the discharge ports seg0 and seg1 of the chip CH1 are 0.375(=0.375+0) for the discharge port seg0 and 1.125 (=0.875+0.25) for the discharge port seg1.

In summary, in the overlapping portion, the discharge port seg6 of the chip CH0 has a dot impact position of 1.875 and the discharge port seg0 of the chip CH1 a dot impact position of 0.375. Although corresponding to the discharge ports located at the same position in the Y direction, the dots are formed at different positions in the X direction. The discharge port seg7 of the chip CH0 has a dot impact position of 2.625, and the discharge port seg0 of the chip CH1 a dot impact position of 1.125. Again, although corresponding to the discharge ports located at the same position in the Y direction, the dots are formed at different positions in the X direction. The second comparative embodiment is thus also unable to make the impact positions of the dots the same between the chips CH0 and CH1 forming the overlapping portion. This causes a drop in the image quality.

Figure 13:
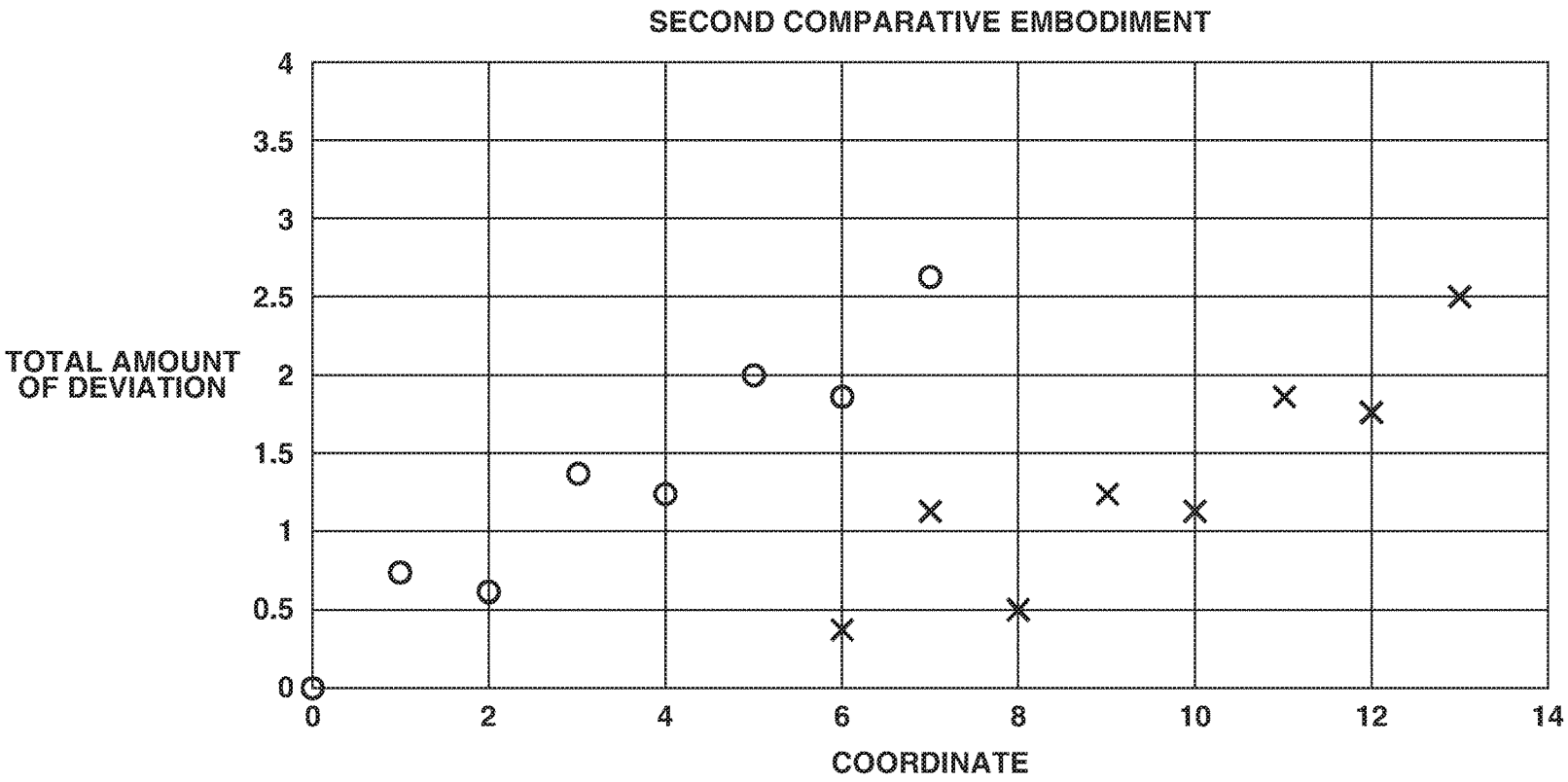
FIG. 13 is a chart illustrating a total amount of deviation according to the comparative embodiment.

FIG. 13 is a chart illustrating the correlation between the coordinate and the dot impact position in the case where the second comparative embodiment is applied. The horizontal axis of FIG. 13 indicates the coordinates illustrated in FIGS. 12A and 12B. The vertical axis indicates the total amounts of deviation (dot impact positions) illustrated in FIGS. 12A and 12B. The marks ○ represent the impact positions of the dots from the chip CH0. The marks × represent the impact positions of the dots from the chip CH1.

As can be seen from FIG. 13, if the second comparative embodiment is used, the positions of the marks o and those of the marks × can be brought closer to each other, i.e., the impact positions of the dots of the chips CH0 and CH1 can be brought closer to each other than in the first comparative embodiment illustrated in FIG. 11. However, even if the second comparative embodiment is used, the marks ○ and × do not overlap at the coordinate "6" corresponding to the discharge port seg6 of the chip CH0 and the discharge port seg0 of the chip CH1 or at the coordinate "7" corresponding to the discharge port seg7 of the chip CH0 and the discharge port seg1 of the chip CH1, i.e., fall on different positions. Even in the second comparative embodiment, the impact positions of the dots of the chips CH0 and CH1 thus differ at the coordinates "6" and "7" corresponding to the overlapping portion.

From the foregoing comparisons with the first and second comparative embodiments, it can be seen that a drop in the image quality in the overlapping portion can be suppressed by performing the offsetting of the driving order and the chip-to-chip pulse delay control as described in the first exemplary embodiment.

A second exemplary embodiment will be described below. In the foregoing first exemplary embodiment, a mode in which the offsetting of the driving order and the pulse delay control are performed has been described.

The present exemplary embodiment describes a mode in which a tilt adjustment to the discharge port arrays in the chips (for the sake of simplicity, may hereinafter be referred to as a rough adjustment) is further made in addition to the offsetting of the driving order and the pulse delay control.

A description of parts similar to those of the foregoing first exemplary embodiment will be omitted.

1. In-Chip Tilt Adjustment (Rough Adjustment)

An in-chip tilt adjustment (rough adjustment) to be made in the present exemplary embodiment will initially be described.

As described above, if the discharge port arrays are obliquely arranged at a predetermined angle of θ with respect to the Y direction, the impact position in each chip deviates by 0.25 in the positive X direction each time the seg number increases by one.

In view of this, in the present exemplary embodiment, the plurality of discharge ports in each discharge port array is divided into a plurality of sections along the direction of arrangement, and a tilt adjustment is made to the sections with respectively different amounts of adjustment. Specifically, the discharge ports seg0 to seg7 are initially divided between a section including the discharge ports seg0 to seg3 and a section including the discharge ports seg4 to seg7. Then, only the pieces of recording data corresponding to the discharge ports seg4 to seg7 among the pieces of recording data corresponding to the discharge ports seg0 to seg7 for recording are shifted by one pixel to the negative X direction side. The reason is that since the impact positions of the dots from the discharge ports seg4 to seg7 deviate by one pixel or more to the positive X direction side due to the tilt of the discharge port array, the pieces of recording data are shifted to the negative X direction side to some extent cancel out the effect of the tilt. In the following description, this will be referred to as a tilt adjustment (rough adjustment).

The tilt adjustment can shift the pieces of recording data by different amounts according to the discharge ports, even if the discharge ports belong to the same chip (discharge port array). More specifically, the pieces of recording data corresponding to the discharge ports seg4 to seg7 among the discharge ports seg0 to seg7 of the chip CH0 can be shifted by one pixel to the negative X direction side while the pieces of recording data corresponding to the discharge ports seg0 to seg3 are left unshifted.

The tilt adjustment is processing for shifting the pieces of recording data that defines whether to record or not pixel by pixel. The shift amount (rough adjustment amount) can thus be set to only integer multiples of the pixel size. In other words, the shift amount (rough adjustment amount) by the tilt adjustment is unable to be set to an amount other than integer multiples of the pixel size. For example, recording data corresponding to a certain discharge port can be shifted by one pixel or two pixels, but not 1.5 pixels.

Figures 1, 14C:
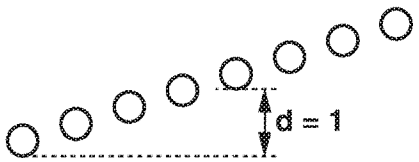
Figures 1, 14B:
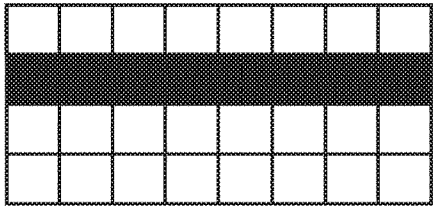
Figures 1, 14A:
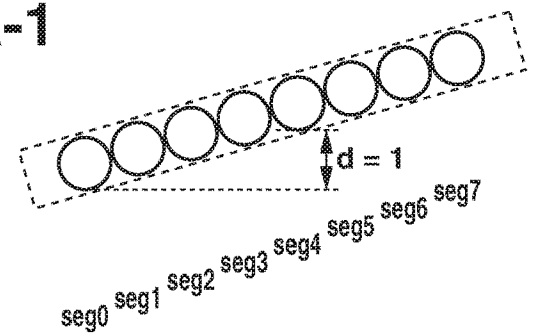
Figures 2, 14C:
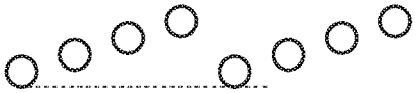
Figures 2, 14B:
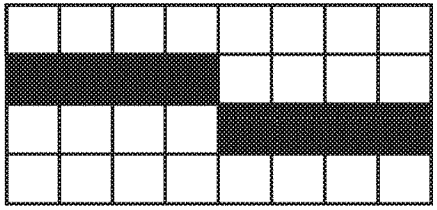
Figures 2, 14A:
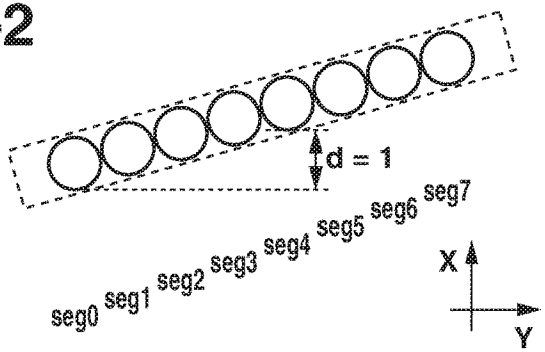

FIGS. 14A-1 to 14C-2 are diagrams illustrating the tilt adjustment. FIGS. 14A-1, 14B-1, and 14C-1 illustrate a case where the tilt adjustment is not performed. FIGS. 14A-2, 14B-2, and 14C-2 illustrate a case where the tilt adjustment is performed. For the sake of simplicity, a case where the discharge ports seg0 to seg7 are simultaneously driven will be described here. The discharge port array used here is the same as those of the chips CH0 to CH3 illustrated in FIG. 2 (FIGS. 14A-1 and 14A-2).

FIG. 14B-1 is a diagram illustrating an example of input recording data. Here, FIG. 14B-1 illustrates a case where there is input recording data in which information representing discharge of ink is defined in eight second pixels from the positive X direction side among a total of 32 pixels including four pixels in the X direction and eight pixels in the Y direction.

FIG. 14C-1 is a schematic diagram illustrating dots formed when recording is performed according to the recording data of FIG. 14B-1 by using the discharge port array of FIG. 14A-1 without a tilt adjustment. Despite the input of the recording data in which the discharge of ink is defined at the same positions in the X direction as illustrated in FIG. 14B-1, the impact positions of the dots deviate in the X direction as illustrated in FIG. 14C-1 due to the tilt of the discharge port array. Specifically, the impact position deviates by 0.25 pixel in the positive X direction each time the seg number increases by one.

As described above, the tilt adjustment shifts the pieces of recording data corresponding to the discharge ports seg4 to seg7, among the discharge ports seg0 to seg7, to the negative X direction side. The discharge ports seg4 to seg7 are the discharge ports of which the impact positions of the dots deviate by one pixel or more if the tilt adjustment is not performed.

FIG. 14B-2 is a diagram illustrating the recording data obtained after the tilt adjustment is performed on the recording data illustrated in FIG. 14B-1. Similarly to the recording data obtained before the tilt adjustment, the recording data corresponding to the discharge ports seg0 to seg3 includes the information indicating the discharge of ink in the second pixels from the positive X direction side. On the other hand, the recording data corresponding to the discharge ports seg4 to seg7 is shifted by one pixel in the negative X direction by the tilt adjustment. As a result, the recording data corresponding to the discharge ports seg4 to seg7 includes the information indicating the discharge of ink in the third pixels from the positive X direction side.

FIG. 14C-2 is a schematic diagram illustrating dots formed when recording is performed according to the recording data of FIG. 14B-2 by using the discharge port array of FIG. 14A-2 and performing the tilt adjustment. As illustrated in FIG. 14C-2, the dots from the discharge ports seg0 to seg3 impact on the same positions as in FIG. 14C-1 without a tilt adjustment. On the other hand, the impact positions of the dots from the discharge ports seg4 to seg7 deviate by one pixel in the negative X direction each, compared to FIG. 14C-1. As illustrated in FIG. 14C-2, the impact positions of the dots from the discharge ports seg0 to seg7 can thus be controlled within a certain range (one pixel) in the X direction, not extending diagonally right up. This can cancel out a drop in the image quality due to the tilt of the discharge port array to some extent.

2. Chip-to-Chip Impact Position Deviation Adjustment by Chip-to-Chip Pulse Delay Control In the present exemplary embodiment, similarly to the first exemplary embodiment, a chip-to-chip impact position deviation adjustment is performed by pulse delay control. Unlike the first exemplary embodiment, the present exemplary embodiment includes performing in-chip tilt adjustment. In the present exemplary embodiment, the pulse delay amount by the pulse delay control is determined in consideration of the effect of the in-chip tilt adjustment.

For example, the discharge ports seg6 and seg7 of the chip CH0 forming one side of the overlapping portion have a deviation amount of 6/4×d(=1.5) and 7/4×d(=1.75), respectively, in the positive X direction from the reference position due to the tilt of the discharge port array.

As described above, an in-chip tilt adjustment of one pixel in the negative X direction is made to the recording data corresponding to the discharge ports seg4 to seg7. The deviation amount of −1 in the positive X direction (=deviation amount of 1 in the negative X direction) by the in-chip tilt adjustment is thus added to the deviation amounts of the discharge ports seg6 and seg7 in the chip CH0.

In consideration of the amount to be cancelled out by the tilt adjustment, the discharge port seg6 has a deviation amount of 0.5(=1.5−1) and the discharge port seg7 a deviation amount of 0.75(=1.75−1) due to the tilt of the discharge port array of the chip CH0.

Meanwhile, the discharge ports seg0 and seg1 of the chip CH1 forming the other side of the overlapping portion have a deviation amount of 0/4×d(=0) and 1/4×d(=0.25), respectively, in the positive X direction from the reference position due to the tilt of the discharge port array. No in-chip tilt adjustment is made to the discharge ports seg0 and seg1.

As a result, there occurs a difference of 0.5(=0.5−0, and =0.75−0.25) between the impact position deviations of the chips CH0 and CH1 due to the tilt of the discharge port arrays.

In view of this, in the present exemplary embodiment, the pulse delay amount is set to 0.5 pixel. This can cancel out the difference between the impact position deviations of the chips CH0 and CH1 in the overlapping portion due to the tilt of the discharge port arrays.

3. Chip-to-Chip Impact Positions According to Second Exemplary Embodiment

FIG. 15A is a chart illustrating the dot impact positions of the chip CH0 according to the present exemplary embodiment. FIG. 15B is a chart illustrating the dot impact positions of the chip CH1 according to the present exemplary embodiment.

The chip CH0 will initially be described.

Similarly to the first exemplary embodiment, the driving deviation amount increases by 1/8×d(=0.125) each time the driving order increases by one. The discharge ports seg0 to seg7 are driven in the driving order of 1, 5, 2, 6, 3, 7, 4, and 8, respectively. The "driving deviation amount" field of FIG. 15A illustrates the driving deviation amounts.

Similarly to the first exemplary embodiment, the tilt deviation amount also increases by 1/4×d(=0.25) each time the seg number increases by one. The "tilt deviation amount" field of FIG. 15A illustrates the tilt deviation amounts.

The recording data corresponding to the discharge ports seg4 to seg7 is shifted by one pixel in the negative X direction by the tilt adjustment. The adjustment amount by the tilt adjustment (hereinafter, also referred to as a rough adjustment amount) of −1 is therefore added to the deviation amounts of the discharge ports seg4 to seg7 ("rough adjustment amount" field of FIG. 15A). The discharge ports seg0 to seg3 have a rough adjustment amount of 0.

The deviation amounts (dot impact positions) from the reference position in the chip CH0 are the sums of the driving deviation amounts, the tilt deviation amounts, and the rough adjustment amounts of the respective discharge ports seg0 to seg7 in the chip CH0. Specifically, the "total amount of deviation" field of FIG. 15A illustrates the deviation amounts (dot impact positions) of the respective discharge ports seg0 to seg7 of the chip CH0 from the reference position.

Next, the chip CH1 will be described.

Similarly to the first exemplary embodiment, the offsetting of the driving order is performed on the discharge ports seg0 to seg7 of the chip CH1. The discharge ports seg0 to seg7 are thus driven in the driving order of 4, 8, 1, 5, 2, 6, 3, and 7, respectively. The "driving deviation amount" field of FIG. 15B illustrates the driving deviation amounts.

The discharge port arrays of the chips CH0 and CH1 have the same tilt. As illustrated in the "tilt deviation amount" field of FIG. 15B, the tilt deviation amounts of the chip CH1 are the same as those of the chip CH0.

The tilt adjustment is performed on the chip CH1 in a similar manner to that on the chip CH0. As illustrated in the "rough adjustment amount" field of FIG. 15B, the rough adjustment amounts of the chip CH1 are the same as those of the chip CH0.

In the present exemplary embodiment, the pulse delay control is performed on the chip CH1 as described above. Here, the application timing of the driving pulses is shifted so that the impact positions of the dots from the chip CH1 are shifted by 0.5 pixel to the positive X direction side from those of the chip CH0 as described above. In the chip CH1, the impact position of each dot therefore deviates as much as the sum of the "driving deviation amount", the "tilt deviation amount", the "rough adjustment amount", and the "pulse delay amount". The "total amount of deviation" field of FIG. 15B illustrates the resulting deviation amounts (dot impact positions) of the respective discharge ports seg0 to seg7 of the chip CH1 from the reference position.

Focusing attention on the discharge ports seg6 and seg7 of the chip CH0 and the discharge ports seg0 and seg1 of the chip CH1 which form the overlapping portion, the impact positions of the dots from the discharge ports will be described in detail.

The discharge ports seg6 and seg7 of the chip CH0 are driven by the time-divisional driving so that the discharge port seg6 is the fourth and the discharge port seg7 the eighth in the driving order. The discharge port seg6 thus has a driving deviation amount of 3/8×d(=0.375), and the discharge port seg7 a driving deviation amount of 7/8×d (=0.875). The discharge port seg6 has a tilt deviation amount of 6/4×d(=1.5), and the discharge port seg7 a tilt deviation amount of 7/4×d(=1.75). The discharge ports seg6 and seg7 both have a rough adjustment amount of −1.

Consequently, as illustrated in the "total amount of deviation" field of FIG. 15A, the impact positions of the dots from the discharge ports seg6 and seg7 of the chip CH0 are 0.875(=0.375+1.5−1) for the discharge port seg6 and 1.625 (=0.875+1.75−1) for the discharge port seg7.

The discharge ports seg0 and seg1 of the chip CH1 are driven by the time-divisional driving so that the discharge port seg0 is the fourth and the discharge port seg1 the eighth in the driving order. The discharge port seg0 thus has a driving deviation amount of 3/8×d(=0.375), and the discharge port seg1 a driving deviation amount of 7/8×d (=0.875). The discharge port seg0 has a tilt deviation amount of 0/4×d(=0), and the discharge port seg1 a tilt deviation amount of 1/4×d(=0.25). The discharge ports seg0 and seg1 both have a pulse delay amount of 0.5. The discharge ports seg0 and seg1 both have a rough adjustment amount of 0.

Consequently, as illustrated in the "total amount of deviation" field of FIG. 15B, the impact positions of the dots from the discharge ports seg0 and seg1 of the chip CH1 are 0.875(=0.375+0+0.5−0) for the discharge port seg0 and 1.625(=0.875+0.25+0.5−0) for the discharge port seg1.

In summary, the dot impact positions of both the discharge port seg6 of the chip CH0 and the discharge port seg0 of the chip CH1 are 0.875. The dot impact positions of both the discharge port seg7 of the chip CH0 and the discharge port seg1 of the chip CH1 are 1.625. Since the impact positions of the dots of the chips CH0 and CH1 forming the overlapping portion can be made the same, a drop in the image quality in the overlapping portion can be suppressed.

Figure 16:
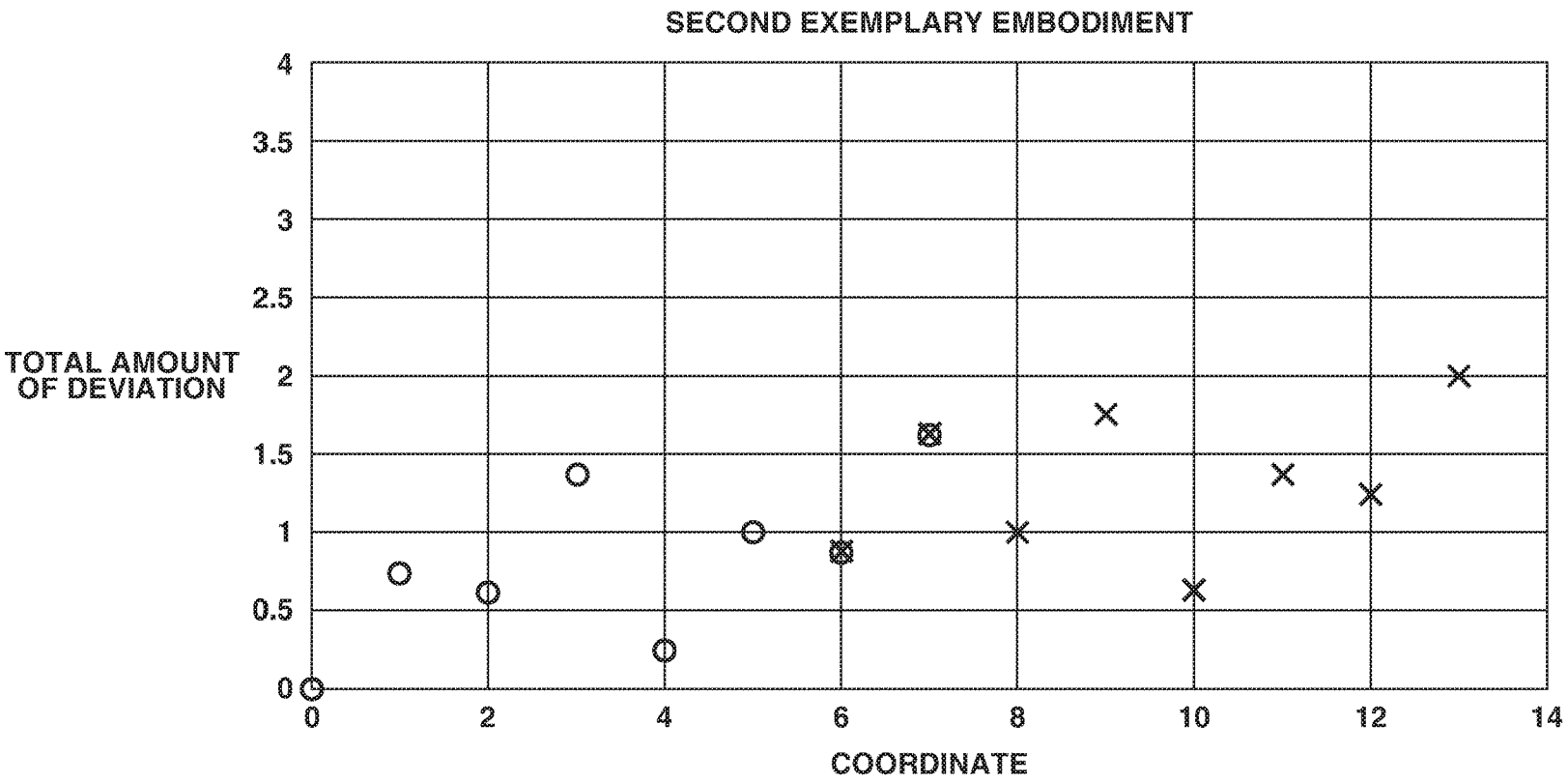
FIG. 16 is a chart illustrating a total amount of deviation according to the exemplary embodiment.

FIG. 16 is a chart illustrating the correlation between the coordinate and the dot impact position in the case where the present exemplary embodiment is applied. The horizontal axis of FIG. 16 indicates the coordinates illustrated in FIGS. 15A and 15B. The vertical axis indicates the total amounts of deviation (dot impact positions) illustrated in FIGS. 15A and 15B. The marks ○ represent the impact positions of the dots from the chip CH0. The marks × represent the impact positions of the dots from the chip CH1.

As can be seen from FIG. 16, if the present exemplary embodiment is used, the marks ○ and × overlap at the coordinate "6" corresponding to the discharge port seg6 of the chip CH0 and the discharge port seg0 of the chip CH1 and at the coordinate "7" corresponding to the discharge port seg7 of the chip CH0 and the discharge port seg1 of the chip CH1. In other words, according to the present exemplary embodiment, the impact positions of the chips CH0 and CH1 can be made the same at the coordinates "6" and "7".

A comparison between FIG. 16 (second exemplary embodiment) and FIG. 9 (first exemplary embodiment) shows that according to the present exemplary embodiment, the impact positions can be controlled within a certain range.

In the first exemplary embodiment illustrated in FIG. 9, for example, the dots at coordinates "11", "12", and "13" impact on positions three pixels or more away from the reference position.

By contrast, in the present exemplary embodiment illustrated in FIG. 16, the impact positions of the dots fall within positions two pixels or less from the reference position even at the coordinates "11", "12", and "13". The reason is that the recording data of the discharge ports seg5, seg6, and seg7 of the chip CH1 (corresponding to the coordinates "11", "12", and "13"), highly affected by the tilt deviations, can be shifted in the negative X direction and the deviation amounts in the positive X direction from the reference position can be reduced by making the tilt adjustment.

A third exemplary embodiment will be described below. In the foregoing second exemplary embodiment, the offsetting of the driving order, the pulse delay control, and the tilt adjustment are described to be performed.

In the present exemplary embodiment, a control for shifting a start position of the tilt adjustment (hereinafter, also referred to as a rough adjustment start position) is performed in addition to the foregoing controls according to the second exemplary embodiment.

A description of parts similar to those of the foregoing second exemplary embodiment will be omitted.

1. Shifting of Rough Adjustment Start Position

In the second exemplary embodiment, a pulse delay control of 0.5 pixel is performed on the discharge ports seg0 to seg7 of the chip CH1. The value of 0.5 pixel is an amount needed to cancel out the effect of the tilt deviation amounts and the rough adjustment amounts of the discharge ports seg6 and seg7 of the chip CH0 on the discharge ports seg0 and seg1 of the chip CH1 and align the impact positions of the discharge ports seg6 and seg7 of the chip CH0 and those of the discharge ports seg0 and seg1 of the chip CH1.

The discharge ports of the chip CH1 that do not constitute an overlapping portion with another chip, such as the discharge ports seg2 and seg3, will not discharge ink to the same positions in the Y direction in a shared manner with discharge ports of other chips. Such discharge ports originally do not need a pulse delay of 0.5 pixel.

As described above, the pulse delay control has the limitation that the application timing of the driving pulses to all the discharge ports belonging to the same chip (discharge port array) is to be delayed by the same amounts. For that reason, pulse delay of 0.5 pixel is performed on the discharge ports seg2 and seg3 of which the application timing does not even need to be delayed. In other words, in the second exemplary embodiment, the impact positions of the dots from the discharge ports seg2 and seg3 are unnecessarily shifted by 0.5 pixel in the positive X direction.

In view of this, in the present exemplary embodiment, the rough adjustment start position of the chip CH1 is advanced, compared to that of the chip CH0.

In the second exemplary embodiment, no rough adjustment is made to the discharge ports seg0 to seg3 of both the chips CH0 and CH1. A rough adjustment with a rough adjustment amount of −1 is made to the discharge ports seg4 to seg7 of both the chips CH0 and CH1. In other words, the rough adjustment start position (discharge port at which a rough adjustment is started) is the discharge port seg4.

By contrast, in the present exemplary embodiment, the rough adjustment start position of the chip CH1 is shifted by two discharge ports to the discharge port seg2.

Specifically, no rough adjustment is made to the discharge ports seg0 to seg1 of the chip CH1. A rough adjustment with a rough adjustment amount of −1 is made to the discharge ports seg2 to seg5. A rough adjustment with a rough adjustment amount of −2 is made to the discharge ports seg6 and seg7.

That is, while no rough adjustment is made to the discharge ports seg2 and seg3 of the chip CH1 in the second exemplary embodiment, a rough adjustment of −1 is made to the discharge ports seg2 and seg3 of the chip CH1 in the present exemplary embodiment. This can cancel out unneeded deviations in the impact positions of the dots from the discharge ports seg2 and seg3 of the chip CH1 due to the foregoing pulse delay control as much as possible.

2. Chip-to-Chip Impact Positions According to Third Exemplary Embodiment

FIG. 17A is a chart illustrating the dot impact positions of the chip CH0 according to the present exemplary embodiment. FIG. 17B is a chart illustrating the dot impact positions of the chip CH1 according to the present exemplary embodiment.

The chip CH0 will initially be described.

The "driving deviation amounts", the "tilt deviation amounts", and the "rough adjustment amounts" of the discharge ports seg0 to seg7 of the chip CH0 are the same as those of the second exemplary embodiment. As illustrated in the "total amount of deviation" field of FIG. 17A, the deviation amounts (dot impact positions) of the discharge ports seg0 to seg7 of the chip CH0 from the reference position are therefore the same as the "total amounts of deviation" according to the second exemplary embodiment illustrated in FIG. 15A.

Next, the chip CH1 will be described.

The "driving deviation amounts", the "tilt deviation amounts", and the "pulse delay amounts" of the discharge ports seg0 to seg7 of the chip CH1 are the same as those of the second exemplary embodiment.

Unlike the second exemplary embodiment, the rough adjustment amounts are subjected to the foregoing shift of the rough adjustment start position. The "rough adjustment amount" field of FIG. 17B illustrates the resulting rough adjustment amounts.

The deviation amounts of the respective discharge ports seg0 to seg7 of the chip CH1 from the reference position are the sums of the "driving deviation amounts", the "tilt deviation amounts", the "rough adjustment amounts", and the "pulse delay amounts". Specifically, the "total amount of deviation" field of FIG. 17B illustrates the deviation amounts.

Focusing attention on the discharge ports seg6 and seg7 of the chip CH0 and the discharge ports seg0 and seg1 of the chip CH1 which form an overlapping portion, the impact positions of the dots from the discharge ports will be described in detail.

The discharge ports seg6 and seg7 of the chip CH0 are driven by the time-divisional driving so that the discharge port seg6 is the fourth and the discharge port seg7 the eighth in the driving order. The discharge port seg6 thus has a driving deviation amount of 3/8×d(=0.375), and the discharge port seg7 a driving deviation amount of 7/8×d (=0.875). The discharge port seg6 has a tilt deviation amount of 6/4×d=(1.5), and the discharge port seg7 a tilt deviation amount of 7/4×d(=1.75). The discharge ports seg6 and seg7 both have a rough adjustment amount of −1.

Consequently, as illustrated in the "total amount of deviation" field of FIG. 17A, the impact positions of the dots from the discharge ports seg6 and seg7 of the chip CH0 are 0.875(=0.375+1.5−1) for the discharge port seg6 and 1.625 (=0.875+1.75−1) for the discharge port seg7.

The discharge ports seg0 and seg1 of the chip CH1 are driven by the time-divisional driving so that the discharge port seg0 is the fourth and the discharge port seg1 the eighth in the driving order. The discharge port seg0 thus has a driving deviation amount of 3/8×d(=0.375), and the discharge port seg1 a driving deviation amount of 7/8×d (=0.875). The discharge port seg0 has a tilt deviation amount of 0/4×d(=0), and the discharge port seg1 a tilt deviation amount of 1/4×d(=0.25). The discharge ports seg0 and seg1 both have a pulse delay amount of 0.5. The discharge ports seg0 and seg1 both have a rough adjustment amount of 0.

Consequently, as illustrated in the "total amount of deviation" field of FIG. 17B, the impact positions of the dots from the discharge ports seg0 and seg1 of the chip CH1 are 0.875(=0.375+0+0.5−0) for the discharge port seg0 and 1.625(=0.875+0.25+0.5−0) for the discharge port seg1.

In summary, the dot impact positions of both the discharge port seg6 of the chip CH0 and the discharge port seg0 of the chip CH1 are 0.875. The dot impact positions of both the discharge port seg7 of the chip CH0 and the discharge port seg1 of the chip CH1 are 1.625. Since the impact positions of the dots of the chips CH0 and CH1 forming the overlapping portion can be made the same, a drop in the image quality in the overlapping portion can be suppressed.

In the overlapping portion, the dot impact positions of both the chips CH0 and CH1 are the same as in the second exemplary embodiment.

Figure 18:
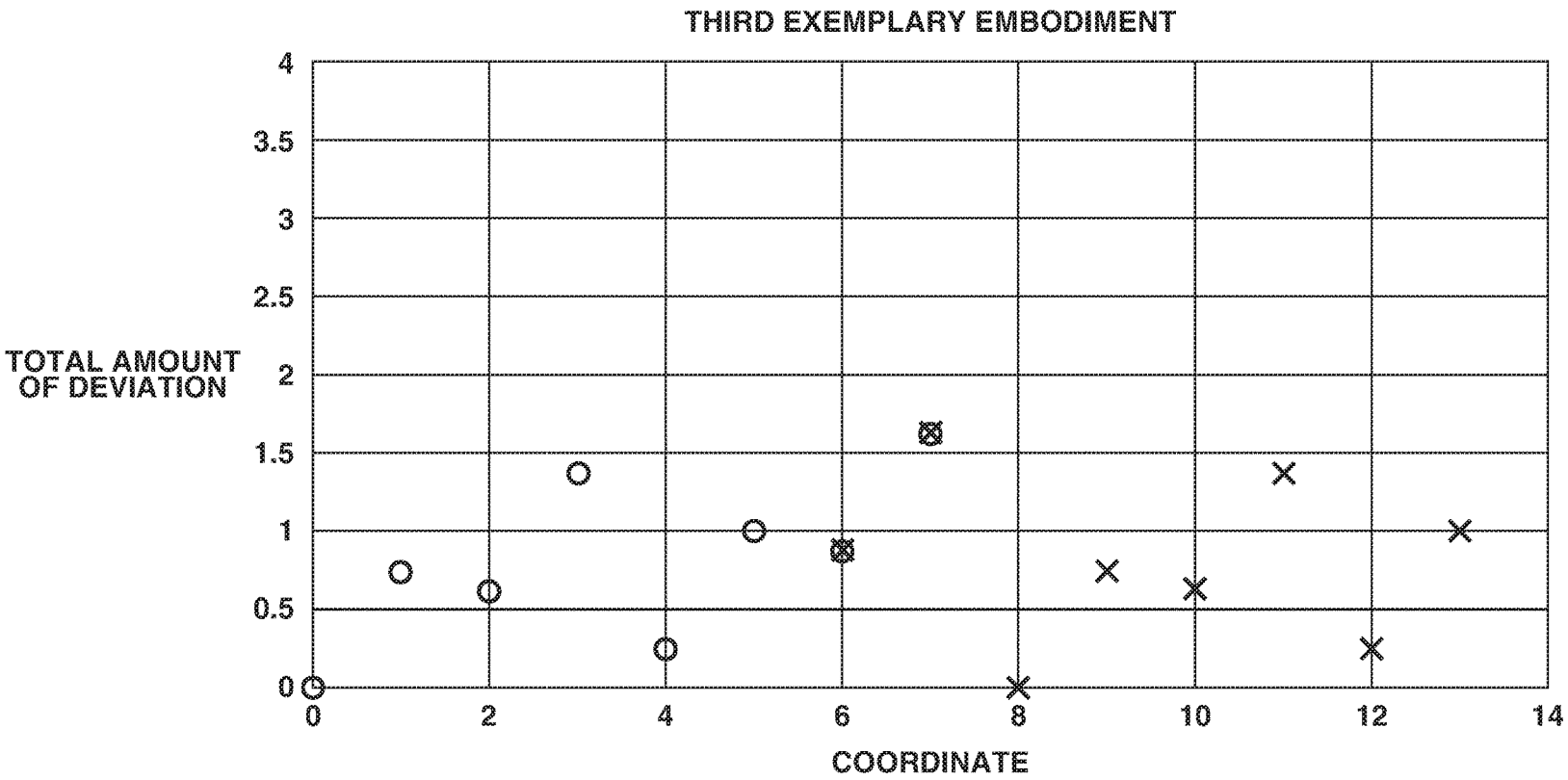
FIG. 18 is a chart illustrating a total amount of deviation according to the exemplary embodiment.

FIG. 18 is a chart illustrating the correlation between the coordinate and the dot impact position in the case where the present exemplary embodiment is applied. The horizontal axis of FIG. 18 indicates the coordinates illustrated in FIGS. 17A and 17B. The vertical axis indicates the total amounts of deviation (dot impact positions) illustrated in FIGS. 17A and 17B. The marks ○ represent the impact positions of the dots from the chip CH0. The marks × represent the impact positions of the dots from the chip CH1.

As can be seen from FIG. 18, if the present exemplary embodiment is used, the marks ○ and × overlap at the coordinate "6" corresponding to the discharge port seg6 of the chip CH0 and the discharge port seg0 of the chip CH1 and at the coordinate "7" corresponding to the discharge port seg7 of the chip CH0 and the discharge port seg1 of the chip CH1. In other words, according to the present exemplary embodiment, the impact positions of the chips CH0 and CH1 can be made the same at the coordinates "6" and "7".

A comparison between FIG. 18 (third exemplary embodiment) and FIG. 16 (second exemplary embodiment) shows that according to the present exemplary embodiment, the deviation amounts of the impact positions of the discharge ports that do not form an overlapping portion can be made even smaller than in the second exemplary embodiment.

In the second exemplary embodiment illustrated in FIG. 16, for example, the dots at coordinates "8" and "9" impact on positions one pixel or more away from the reference position.

By contrast, in the present exemplary embodiment illustrated in FIG. 18, the impact positions of the dots at the coordinates "8" and "9" fall within positions less than one pixel from the reference position. The reason is that a rough adjustment with a rough adjustment amount of −1 can also be made to the discharge ports seg2 and seg3 of the chip CH1 (corresponding to the coordinates "8" and "9") and unneeded deviations in the impact positions of the dots from the discharge ports that do not form an overlapping portion due to the pulse delay control can be reduced by shifting the rough adjustment start position.

A fourth exemplary embodiment will be described below. In the foregoing third exemplary embodiment, the offsetting of the driving order, the pulse delay control, the tilt adjustment (rough adjustment), and the shift of the rough adjustment start position are described to be performed.

In the present exemplary embodiment, if the impact position of each discharge port does not fall within a predetermined range (within a reference range), an adjustment specific to the discharge port (hereinafter, may be referred to as a fine adjustment) is made in addition to the foregoing controls according to the second exemplary embodiment. The fine adjustment is made to shift the recording data of the discharge port so that the dot impacts within the reference range.

A description of parts similar to those of the foregoing third exemplary embodiment will be omitted.

1. Impact Adjustment Specific to Each Discharge Port (Fine Adjustment)

An impact adjustment specific to each discharge port (fine adjustment) to be made in the present exemplary embodiment will be described.

In the present exemplary embodiment, the recording data of a discharge port of which the sum of the driving deviation amount, the tilt deviation amount, the rough adjustment amount, and the pulse delay amount is one pixel or more is shifted in the negative X direction after the controls of the third exemplary embodiment are performed. The amount of shift here is set to an integer multiple of the pixel size so that the shifted impact position becomes less than one pixel.

Details will be described. As illustrated in FIG. 18, there are discharge ports of which the total amount of deviation is one pixel or more even after the controls of the third exemplary embodiment are performed. For example, the discharge port seg3 of the chip CH0 has a total amount of deviation of 1.375 and the discharge port seg7 of the chip CH0 a total amount of deviation of 1.625, i.e., one pixel or more. The discharge ports seg1 and seg5 of the chip CH1 also have a total amount of deviation of one pixel or more.

By the impact adjustment specific to each discharge port (fine adjustment) according to the present exemplary embodiment, the pieces of recording data corresponding to the discharge ports seg3 and seg7 of the chip CH0 and the discharge ports seg1 and seg5 of the chip CH1 mentioned above are adjusted with a fine adjustment amount of −1. In other words, the pieces of recording data corresponding to the discharge ports seg3 and seg7 of the chip CH0 and the discharge ports seg1 and seg5 of the chip CH1 are shifted by one pixel in the negative X direction.

By such a fine adjustment, all the dots from the discharge ports seg0 to seg7 of the chips CH0 and CH1 can be controlled within the range of one pixel or less. This can reduce variations in the impact positions of the dots from the discharge ports seg0 to seg7 to suppress a drop in image quality.

2. Chip-to-Chip Impact Positions According to Fourth Exemplary Embodiment

FIG. 19A is a chart illustrating the dot impact positions of the chip CH0 according to the present exemplary embodiment. FIG. 19B is a chart illustrating the dot impact positions of the chip CH1 according to the present exemplary embodiment.

The chip CH0 will initially be described.

The "driving deviation amounts", the "tilt deviation amounts", and the "rough adjustment amounts" of the discharge ports seg0 to seg7 of the chip CH0 are the same as those of the third exemplary embodiment.

As illustrated in the "fine adjustment amount" field of FIG. 19A, a fine adjustment amount of −1 is set for the discharge ports seg3 and seg7 as described above. The fine adjustment amounts of the other discharge ports seg0 to seg2 and seg4 to seg6 are 0.

The deviation amounts of the respective discharge ports seg0 to seg7 of the chip CH0 from the reference position are the sums of the "driving deviation amounts", the "tilt deviation amounts", the "rough adjustment amounts", and the "fine adjustment amounts". Specifically, the "total amount of deviation" field of FIG. 19A illustrates the deviation amounts of the discharge ports seg0 to seg7.

Next, the chip CH1 will be described.

The "driving deviation amounts", the "tilt deviation amounts", the "rough adjustment amounts", and the "pulse delay amounts" of the discharge ports seg0 to seg7 of the chip CH1 are the same as in the third exemplary embodiment.

As illustrated in the "fine adjustment amount" field of FIG. 19B, a fine adjustment amount of −1 is set for the discharge ports seg1 and seg5 as described above. The fine adjustment amounts of the other discharge ports seg0, seg2 to seg4, seg6, and seg7 are 0.

The deviation amounts of the respective discharge ports seg0 to seg7 of the chip CH1 from the reference position are the sums of the "driving deviation amounts", the "tilt deviation amounts", the "rough adjustment amounts", the "fine adjustment amounts", and the "pulse delay amounts". Specifically, the "total amount of deviation" field of FIG. 19B illustrates the deviation amounts of discharge ports seg0 to seg7.

Focusing attention on the discharge ports seg6 and seg7 of the chip CH0 and the discharge ports seg0 and seg1 of the chip CH1 which form an overlapping portion, the impact positions of the dots from the discharge ports will be described in detail.

The discharge ports seg6 and seg7 of the chip CH0 are driven by the time-divisional driving so that the discharge port seg6 is the fourth and the discharge port seg7 the eighth in the driving order. The discharge port seg6 thus has a driving deviation amount of 3/8×d(=0.375), and the discharge port seg7 a driving deviation amount of 7/8×d (=0.875). The discharge port seg6 has a tilt deviation amount of 6/4×d(=1.5), and the discharge port seg7 a tilt deviation amount of 7/4×d(=1.75). The discharge ports seg6 and seg7 both have a rough adjustment amount of −1. The discharge port seg6 has a fine adjustment amount of 0, and the discharge port seg7 a fine adjustment amount of −1.

Consequently, as illustrated in the "total amount of deviation" field of FIG. 19A, the impact positions of the dots from the discharge ports seg6 and seg7 of the chip CH0 are 0.875(=0.375+1.5−1−0) for the discharge port seg6 and 0.625(=0.875+1.75−1−1) for the discharge port seg7.

The discharge ports seg0 and seg1 of the chip CH1 are driven by the time-divisional driving so that the discharge port seg0 is the fourth and the discharge port seg1 the eighth in the driving order. The discharge port seg0 thus has a driving deviation amount of 3/8×d(=0.375), and the discharge port seg1 a driving deviation amount of 7/8×d (=0.875). The discharge port seg0 has a tilt deviation amount of 0/4×d(=0), and the discharge port seg1 a tilt deviation amount of 1/4×d=(0.25). The discharge ports seg0 and seg1 both have a pulse delay amount of 0.5. The discharge ports seg0 and seg1 both have a rough adjustment amount of 0. The discharge port seg0 has a fine adjustment amount of 0, and the discharge port seg1 a fine adjustment amount of −1.

Consequently, as illustrated in the "total amount of deviation" field of FIG. 19B, the impact positions of the dots from the discharge ports seg0 and seg1 of the chip CH1 are 0.875(=0.375+0+0.5−0−0) for the discharge port seg0 and 0.625(=0.875+0.25+0.5−0−1) for the discharge port seg1.

In summary, the dot impact positions of both the discharge port seg6 of the chip CH0 and the discharge port seg0 of the chip CH1 are 0.875. The dot impact positions of both the discharge port seg7 of the chip CH0 and the discharge port seg1 of the chip CH1 are 0.625. Since the impact positions of the dots of the chips CH0 and CH1 forming the overlapping portion can be made the same, a drop in the image quality in the overlapping portion can be suppressed.

Figure 20:
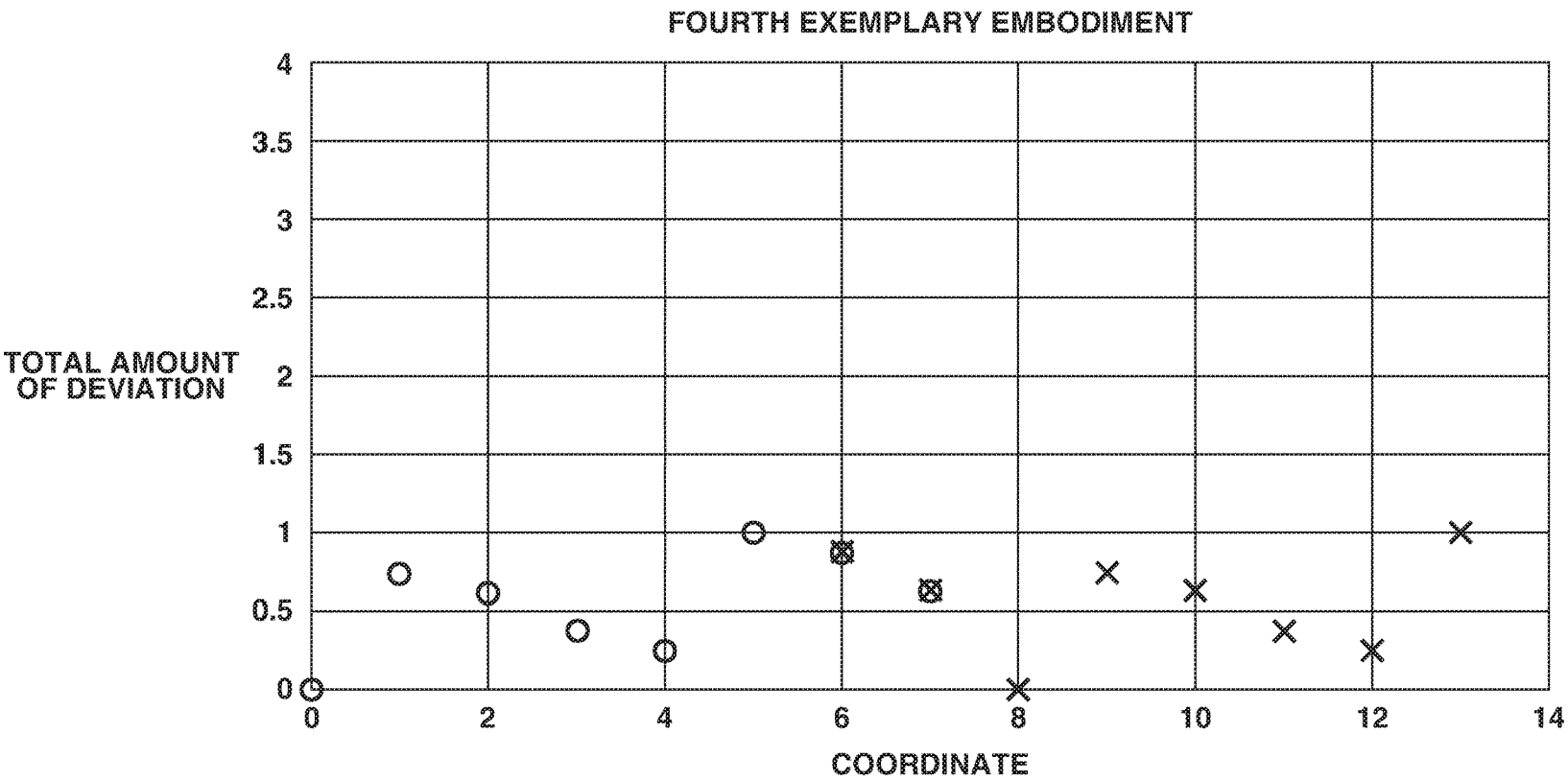
FIG. 20 is a chart illustrating a total amount of deviation according to the exemplary embodiment.

FIG. 20 is a chart illustrating the correlation between the coordinate and the dot impact position in the case where the present exemplary embodiment is applied. The horizontal axis of FIG. 20 indicates the coordinates illustrated in FIGS. 19A and 19B. The vertical axis indicates the total amounts of deviation (dot impact positions) illustrated in FIGS. 19A and 19B. The marks ○ represent the impact positions of the dots from the chip CH0. The marks × represent the impact positions of the dots from the chip CH1.

As can be seen from FIG. 20, if the present exemplary embodiment is used, the marks ○ and × overlap at the coordinate "6" corresponding to the discharge port seg6 of the chip CH0 and the discharge port seg0 of the chip CH1 and at the coordinate "7" corresponding to the discharge port seg7 of the chip CH0 and the discharge port seg1 of the chip CH1. In other words, according to the present exemplary embodiment, the impact positions of the chips CH0 and CH1 can be made the same at the coordinates "6" and "7".

A comparison between FIG. 20 (fourth exemplary embodiment) and FIG. 18 (third exemplary embodiment) shows that according to the present exemplary embodiment, the deviation amounts of the impact positions can be made even smaller than in the third exemplary embodiment.

In the third exemplary embodiment illustrated in FIG. 18, for example, the dots at coordinates "3", "7", and "11" impact on positions one pixel or more away from the reference position.

By contrast, in the present exemplary embodiment illustrated in FIG. 20, the impact positions of the dots at the coordinates "3", "7", and "11" fall within positions one pixel or less from the reference position. By making a fine adjustment with a fine adjustment amount of −1 to the discharge ports seg3 and seg7 of the chip CH0 and the discharge ports seg1 and seg5 of the chip CH1 (corresponding to the coordinates "3", "7", and "11"), the impact position deviations of the dots can be reduced even for the discharge ports of which the impact position deviation amounts fail to be reduced to one pixel or less by using the third exemplary embodiment.

A fifth exemplary embodiment will be described below. In the foregoing exemplary embodiments, the time-divisional driving is described to be performed.

By contrast, the present exemplary embodiment describes a case in which the plurality of discharge ports in a discharge port array is driven at the same time, i.e., simultaneous driving is performed. Specifically, only the tilt adjustment and the chip-to-chip pulse delay control are performed among the foregoing controls.

A description of parts similar to those of the foregoing exemplary embodiments will be omitted.

1. Chip-to-Chip Impact Positions According to Fifth Exemplary Embodiment

FIG. 21A is a chart illustrating the dot impact positions of the chip CH0 according to the present exemplary embodiment. FIG. 21B is a chart illustrating the dot impact positions of the chip CH1 according to the present exemplary embodiment.

The chip CH0 will initially be described.

In the present exemplary embodiment, there occurs no driving deviation (the driving deviation amount is 0) since the simultaneous driving is performed.

Similarly to the foregoing exemplary embodiments, the tilt deviation amount increases by 1/4×d(=0.25) each time the seg number increases by one. The "tilt deviation amount" field of FIG. 21A illustrates the resulting tilt deviation amounts.

Similarly to the second exemplary embodiment, the tilt adjustment (rough adjustment) is made to the discharge ports seg4 to seg7. The rough adjustment amounts of the discharge ports seg4 to seg7 are −1. The rough adjustment amounts of the discharge ports seg0 to seg3 are 0.

The deviation amounts (dot impact positions) from the reference position in the chip CH0 are the sums of the tilt deviation amounts and the rough adjustment amounts of the respective discharge ports seg0 to seg7 in the chip CH0. Specifically, the "total amount of deviation" field of FIG. 21A illustrates the deviation amounts (dot impact positions)

of the respective discharge ports seg0 to seg7 of the chip CH0 from the reference position.

Next, the chip CH1 will be described.

For the chip CH1, there occurs no driving deviation (the driving deviation amount is 0), either, since the simultaneous driving is performed.

The discharge port arrays of the chips CH0 and CH1 have the same tilt. As illustrated in the "tilt deviation amount" field of FIG. 21B, the tilt deviation amounts of the chip CH1 are therefore the same as those of the chip CH0.

The tilt adjustment of the chip CH1 is performed in a similar manner to that of the chip CH0. As illustrated in the "rough adjustment amount" field of FIG. 21B, the rough adjustment amounts of the chip CH1 are the same as those of the chip CH0.

The chip CH1 is subjected to the pulse delay control. Here, the application timing of the driving pulses is shifted so that the impact positions of the dots from the chip CH1 are shifted by 0.5 pixel to the positive X direction side with respect to those of the chip CH0.

In the chip CH1, the impact position of a dot therefore deviates as much as the sum of the "tilt deviation amount", the "rough adjustment amount", and the "pulse delay amount". The "total amount of deviation" field of FIG. 21B illustrates the resulting deviation amounts (dot impact positions) of the respective discharge ports seg0 to seg7 of the chip CH1 from the reference position.

Focusing attention on the discharge ports seg6 and seg7 of the chip CH0 and the discharge ports seg0 and seg1 of the chip CH1 which form an overlapping portion, the impact positions of the dots from the discharge ports will be described in detail.

The tilt deviation amounts of the discharge ports seg6 and seg7 of the chip CH0 are 6/4×d(=1.5) for the discharge port seg6 and 7/4×d(=1.75) for the discharge port seg7. The discharge ports seg6 and seg7 both have a rough adjustment amount of −1.

Consequently, as illustrated in the "total amount of deviation" field of FIG. 21A, the impact positions of the dots from the discharge ports seg6 and seg7 of the chip CH0 are 0.5(=1.5−1) for the discharge port seg6 and 0.75(=1.75−1) for the discharge port seg7.

The tilt deviation amounts of the discharge ports seg0 and seg1 of the chip CH1 are 0/4×d(=0) for the discharge port seg0 and 1/4×d(=0.25) for the discharge port seg1. The discharge ports seg0 and seg1 both have a pulse delay amount of 0.5. The discharge ports seg0 and seg1 both have a rough adjustment amount of 0.

Consequently, as illustrated in the "total amount of deviation" field of FIG. 21B, the impact positions of the dots from the discharge ports seg0 and seg1 of the chip CH1 are 0.5(=0+0.5−0) for the discharge port seg0 and 0.75(=0.25+0.5−0) for the discharge port seg1.

In summary, the dot impact positions of both the discharge port seg6 of the chip CH0 and the discharge port seg0 of the chip CH1 are 0.5. The dot impact positions of both the discharge port seg7 of the chip CH0 and the discharge port seg1 of the chip CH1 are 0.75. Since the impact positions of the dots of the chips CH0 and CH1 forming the overlapping portion can be made the same, a drop in the image quality in the overlapping portion can be suppressed.

Figure 22:
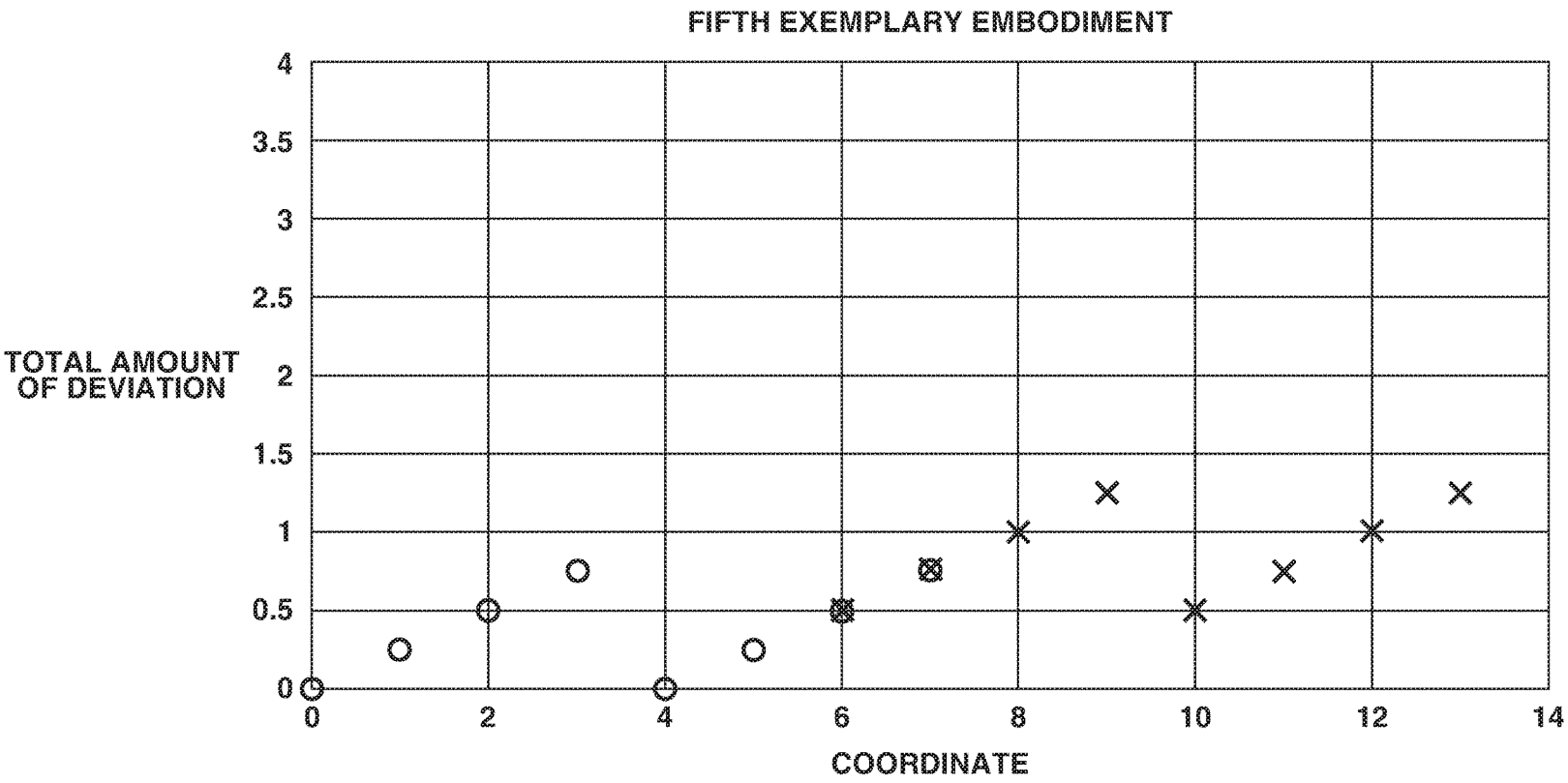
FIG. 22 is a chart illustrating a total amount of deviation according to the exemplary embodiment.

FIG. 22 is a chart illustrating the correlation between the coordinate and the dot impact position in the case where the present exemplary embodiment is applied. The horizontal axis of FIG. 22 indicates the coordinates illustrated in FIGS. 21A and 21B. The vertical axis indicates the total amounts of deviation (dot impact positions) illustrated in FIGS. 21A and 21B. The marks ○ represent the impact positions of the dots from the chip CH0, and the marks × the impact positions of the dots from the chip CH1.

As can be seen from FIG. 22, if the present exemplary embodiment is used, the marks ○ and × overlap at the coordinate "6" corresponding to the discharge port seg6 of the chip CH0 and the discharge port seg0 of the chip CH1 and at the coordinate "7" corresponding to the discharge port seg7 of the chip CH0 and the discharge port seg1 of the chip CH1. In other words, according to the present exemplary embodiment, the impact positions of the chips CH0 and CH1 can be made the same at the coordinates "6" and "7" even in the case where the simultaneous driving is performed.

(Other Exemplary Embodiments)

In the foregoing exemplary embodiments, cyan, magenta, yellow, and black inks are described to be discharged from the different recording heads 105 to 108. However, other exemplary embodiments are also possible. In one exemplary embodiment, cyan, magenta, yellow, and black inks may be discharged from one recording head. Discharge port arrays for discharging cyan, magenta, yellow, and black inks may be provided in the same heater board.

In the foregoing exemplary embodiments, the chip-to-chip pulse delay control is described to be performed on the chip CH1 of the chips CH0 and CH1 so that ink can be discharged to the same positions in the overlapping portion between the chips CH0 and CH1. However, other exemplary embodiments are also possible. An adjustment may be made to advance the discharge timing (the application timing of the driving pulses) of the chip CH0. Both an adjustment to advance the discharge timing of the chip CH0 and an adjustment to delay the discharge timing of the chip CH1 may be made.

In the second to fifth exemplary embodiments, the discharge port arrays are tilted at an angle of θ with respect to the Y direction, and the tilt adjustment (rough adjustment) is made so that the rough adjustment amount decreases by one (the absolute value of the rough adjustment amount increases by one) to reduce the effect of the tilt of the discharge port arrays each time the seg number increases by four. The rough adjustment amount can be set to different values depending on the tilt angle of the discharge port arrays. For example, if the discharge port arrays are tilted at an angle of 2θ with respect to the Y direction, the effect of the tilt can be reduced by reducing the rough adjustment amount by one (increasing the absolute value of the rough adjustment amount by one) each time the seg number increases by two. The rough adjustment amount itself may be doubled when the angle is 2θ, compared to when the angle is θ.

In the foregoing exemplary embodiments, the recording heads longer than the width of the recording medium P are described to be used to perform recording while the recording medium P is being conveyed. However, other exemplary embodiments are also possible. For example, in one exemplary embodiment, a recording operation for discharging ink while scanning a recording head in a direction crossing the direction of arrangement of discharge ports and a conveyance operation for conveying the recording medium in the direction of arrangement between one scan and another may be repeated to complete recording on the recording medium by a plurality of scans (movements).

A recording apparatus according to an exemplary embodiment of the disclosure can suppress a drop in the image quality of recording in overlapping portions between discharge port arrays in a case where a recording head including discharge port arrays obliquely arranged with respect to the width direction of a recording medium is used.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-127996, filed Jun. 29, 2017, which is hereby incorporated by reference herein in its entirety.

What is claimed is:

1. An apparatus comprising:

a recording head including a first discharge port array and a second discharge port array each including a plurality of recording elements configured to generate energy for discharging ink and a plurality of discharge ports provided to correspond to the recording elements, the first and second discharge port arrays being shifted and arranged in a first direction so that part of the discharge ports arranged at an end portion of the first discharge port array in the first direction and part of the discharge ports arranged at an end portion of the second discharge port array in the first direction are located at same positions in the first direction;

a moving unit configured to execute relative movement between the recording head and a recording medium in a second direction crossing the first direction; and a control unit configured to control timing of discharge from the second discharge port array, wherein the plurality of discharge ports, in each of the first and second discharge port arrays, is obliquely arranged at a predetermined tilt with respect to the first direction, and wherein the control unit is configured to adjust the timing of discharge from the second discharge port array by a first adjustment amount according to the predetermined tilt such that the part of the discharge ports of the first discharge port array and the part of the discharge ports of the second discharge port array are capable of discharging the ink to the same positions in the second direction on the recording medium.

2. The apparatus according to claim 1, wherein the control unit is configured to adjust the timing of discharge of all the plurality of discharge ports of the second discharge port array by the first adjustment amount.

3. The apparatus according to claim 1, wherein the first adjustment amount includes an amount other than an amount set to integer multiples of a pixel size of recording data.

4. The apparatus according to claim 1, further comprising a driving unit configured to divide the plurality of recording elements in each of the first and second discharge port arrays into a plurality of driving blocks, and time-divisionally drive the recording elements in predetermined driving order for each driving block, wherein the driving unit is configured to time-divisionally drive the plurality of recording elements so that the recording elements in the part of the discharge ports of the first discharge port array and the recording elements in the part of the discharge ports of the second discharge port array are driven in a same order.

5. The apparatus according to claim 4, wherein the predetermined driving order of the second discharge port array is order obtained by offsetting the predetermined driving order of the first discharge port array.

6. The apparatus according to claim 1, wherein the control unit is configured to divide the plurality of discharge ports in each of the first and second discharge port arrays into a plurality of sections each including a predetermined number of discharge ports along a direction of the predetermined tilt, and further adjust the timing of discharge of each of the sections by a second adjustment amount specific to the section according to the predetermined tilt, and wherein the first adjustment amount is based on the predetermined tilt and the second adjustment amount.

7. The apparatus according to claim 6, wherein the farther a position of the section in the second direction is from a reference position, the greater the second adjustment amount of the section is in absolute value.

8. The apparatus according to claim 6, wherein a position in the first direction of a discharge port at which the second adjustment amount starts to increase in absolute value in the second discharge port array is different from a position in the first direction of a discharge port at which the second adjustment value starts to increase in absolute value in the first discharge port array.

9. The apparatus according to claim 6, wherein the second adjustment amount does not include an amount other than an amount set to integer multiples of a pixel size of recording data.

10. The apparatus according to claim 6, wherein the control unit is configured to further adjust the timing of discharge of a discharge port, that fails to discharge the ink within the predetermined range as a result of adjustment by the first adjustment amount and the second adjustment amount, by a third adjustment amount so that the discharge port discharges the ink within a predetermined range in the second direction.

11. The apparatus according to claim 10, wherein the third adjustment amount does not include an amount other than an amount set to integer multiples of a pixel size of recording data.

12. A method for performing recording by using a recording head including a first discharge port array and a second discharge port array each including a plurality of recording elements configured to generate energy for discharging ink and a plurality of discharge ports provided to correspond to the recording elements, the first and second discharge port arrays being shifted and arranged in a first direction so that part of the discharge ports arranged at an end portion of the first discharge port array in the first direction and part of the discharge ports arranged at an end portion of the second discharge port array in the first direction are located at same positions in the first direction, the method comprising:

executing relative movement between the recording head or a recording medium in a second direction crossing the first direction; and controlling timing of discharge from the second discharge port array, wherein the plurality of discharge ports, in each of the first and second discharge port arrays, is obliquely arranged at a predetermined tilt with respect to the first direction, and wherein the timing of discharge from the second discharge port array is adjusted by a first adjustment amount according to the predetermined tilt such that the part of the discharge ports of the first discharge port array and the part of the discharge ports of the second discharge port array are capable of discharging the ink to the same positions in the second direction on the recording medium.

13. The method according to claim 12, further comprising adjusting the timing of discharge of all the plurality of discharge ports of the second discharge port array by the first adjustment amount.

14. The method according to claim 12, further comprising dividing the plurality of recording elements in each of the first and second discharge port arrays into a plurality of driving blocks, and time-divisionally driving the recording elements in predetermined driving order for each driving block, wherein the time-divisionally driving the plurality of recording elements so that the recording elements in the part of the discharge ports of the first discharge port array and the recording elements in the part of the discharge ports of the second discharge port array are driven in a same order.

15. The method according to claim 14, wherein the predetermined driving order of the second discharge port array is order obtained by offsetting the predetermined driving order of the first discharge port array.

16. The method according to claim 12, further comprising dividing the plurality of discharge ports in each of the first and second discharge port arrays into a plurality of sections each including a predetermined number of discharge ports along a direction of the predetermined tilt, and further adjusting the timing of discharge of each of the sections by a second adjustment amount specific to the section according to the predetermined tilt, wherein the first adjustment amount is based on the predetermined tilt and the second adjustment amount.

17. The method according to claim 16, wherein the farther a position of the section in the second direction is from a reference position, the greater the second adjustment amount of the section is in absolute value.

18. The method according to claim 16, wherein a position in the first direction of a discharge port at which the second adjustment amount starts to increase in absolute value in the second discharge port array is different from a position in the first direction of a discharge port at which the second adjustment value starts to increase in absolute value in the first discharge port array.

19. The method according to claim 16, further comprising adjusting the timing of discharge of a discharge port, that fails to discharge the ink within the predetermined range as a result of adjustment by the first adjustment amount and the second adjustment amount, by a third adjustment amount so that the discharge port discharges the ink within a predetermined range in the second direction.

20. The method according to claim 16, wherein the second adjustment amount does not include an amount other than an amount set to integer multiples of a pixel size of recording data.

* * * * *